United States Patent [19]

Kokubo et al.

[11] Patent Number: 4,712,414

[45] Date of Patent: Dec. 15, 1987

[54] ROLLING METHOD OF PLATE-LIKE STOCK MATERIAL BY EDGER, AND CONTINUOUS HOT ROLLING MILL

[75] Inventors: Ichiro Kokubo, Hyogo; Atsuo Mizuta, Kobe; Yoshitaka Yamamoto, Hyogo; Jitsuo Kitazawa, Kobe, all of Japan

[73] Assignee: Kabushiki Kaisha Kobe Seiko Sho, Kobe, Japan

[21] Appl. No.: 834,509

[22] Filed: Feb. 28, 1986

Related U.S. Application Data

[63] Continuation of Ser. No. 630,725, Jul. 13, 1984, abandoned.

[30] Foreign Application Priority Data

| | | | |
|---|---|---|---|
| Jul. 13, 1983 | [JP] | Japan | 58-128590 |
| Jul. 13, 1983 | [JP] | Japan | 58-128592 |
| Sep. 16, 1983 | [JP] | Japan | 58-171615 |
| Oct. 3, 1983 | [JP] | Japan | 58-185783 |
| Dec. 21, 1983 | [JP] | Japan | 58-242776 |
| Jan. 10, 1984 | [JP] | Japan | 59-003079 |
| Feb. 4, 1984 | [JP] | Japan | 59-019244 |

[51] Int. Cl.[4] ..... B21B 1/30; B21B 39/02

[52] U.S. Cl. ..... 72/366; 72/177; 72/199; 72/235; 72/250

[58] Field of Search ..... 72/235, 234, 226, 224, 72/177, 365, 366, 21, 225, 250, 199

[56] References Cited

U.S. PATENT DOCUMENTS

| | | | |
|---|---|---|---|
| 231,146 | 8/1880 | Briggs | 72/224 |
| 2,090,706 | 8/1937 | Sheperdson | 72/177 |
| 2,183,388 | 12/1939 | Biggert, Jr. | 72/234 X |
| 3,712,095 | 1/1973 | Dowsing et al. | 72/21 |

FOREIGN PATENT DOCUMENTS

| | | | |
|---|---|---|---|
| 435498 | 7/1984 | Australia . | |
| 1069461 | 6/1976 | Japan | 72/235 |
| 0116259 | 10/1978 | Japan | 72/225 |
| 0030008 | 3/1981 | Japan | 72/365 |
| 0165522 | 12/1981 | Japan | 72/224 |
| 0582852 | 12/1977 | U.S.S.R. | 72/225 |

*Primary Examiner*—Robert L. Spruill
*Assistant Examiner*—Steve Katz
*Attorney, Agent, or Firm*—Oblon, Fisher, Spivak, McClelland & Maier

[57] ABSTRACT

A plate-like stock material is rolled or edged to a desired width on an edging stand of an edger. The edging stand is equipped with a pair of vertical rolls. The central axis of at least one of the vertical rolls of the edging stand is tilted within a suitable angle range toward the same direction as the advancing direction of the stock material or toward the direction opposite to the advancing direction of the stock material in a vertical plane parallel to the advancing direction of the stock material. The resulting downward bending deformation is received by a table roller.

3 Claims, 35 Drawing Figures

INFLUENCE OF LENGTHWISE TILT OF EDGER ROLL (AT INCOMING SIDE) ON BUCKLING

ROLLING METHOD OF PLATE-LIKE STOCK MATERIAL BY EDGER, AND CONTINUOUS HOT ROLLING MILL

This application is a continuation of application Ser. No. 630,725, filed July 13, 1984, now abandoned.

BACKGROUND OF THE INVENTION

Field of the Invention

This invention relates to a rolling method making use of an edger in a heavy plate rolling process, and particularly to the rough rolling step in a hot strip rolling process, a blooming process or the like, a continuous hot rolling mill, and a variable caliber type edger roll.

Description of the Prior Art

In the course of the rough rolling in the above-mentioned hot strip rolling process for example, each stock material to be rolled (hereinafter called "stock material" for the sake of brevity) is rolled down to such a thickness that it can be rolled further by its subsequent continuous finishing mill and at the same time, it is also subjected to edge rolling so as to obtain a rolled product having a prescribed width. When effecting the edge rolling by means of a pair of cylindrical vertical rolls as a vertical scale breaker (VSB) or edger in the above width-adjusting rolling, namely, edger-rolling, applications of rolling forces to stock materials often tend to cause the stock materials to ascend at one side thereof where they are in contact with vertical rolls. Accordingly, it is impossible to perform sufficient widthwise rolling, leading to reduced widthwise dimensional accuracy. Furthermore, such an ascent results in the formation of a stepped portion in the corresponding side face of the rolled material, leading to reduced perpendicularity. Thus, such an ascent results in a reduction in production yield. If the above-mentioned one-side ascent phenomenon takes place on a stock material, the ascent side is alternated from the working side to the drive side and vice versa from one pass to another in an edge-rolling pass. This will increasingly reduce the widthwise dimensional accuracy of the stock material and will also promote the deterioration of its end profile. These phenomena are also developed in much the same way in a heavy plate rolling process or in the edger rolling of a blooming process.

A variety of edger rolling methods have heretofore been proposed with a view toward overcoming the above-mentioned problems. For example, a representative method of such conventionally-proposed edger rolling methods to employ tapered rolls having upwardly increasing diameters as vertical rolls or to arrange cylindrical vertical rolls in a fashion tilted widthwise (see, Japanese Patent Laid-open No. 116259/1978) so that a holding force is produced against a stock material to avoid bucking or ascent thereof upon its rolling. However, such mehtods are still unable to achieve any complete prevention of ascent. Conversely, such may in some instances affect adversely on the buckling. In addition, the perpendicularity of the side edge faces of stock materials may be reduced by tapered vertical rolls or widthwise inclination of vertical rolls.

It has also been proposed to provide a holding roll to depress a central part of a stock material. Although such a holding roll appears to be effective for the prevention of bucking or ascent, it requires the rolling mill to be unavoidably complex and its maintenance and servicing thereof difficult. If a stock material is warped upwardly, the stock material strikes the holding roll. This collision of the stock material not only damages equipment but also hinders smooth operation. In addition, it has also been proposed to conduct rolling by using caliber rolls as vertical rolls (see, Japanese Patent Publication No. 7322/1980). Basically speaking, use of such caliber rolls is however intended to achieve considerable widthwise rolling reduction while minimizing the problem of insufficient bite and occurrence of slippage. Caliber rolls are thus accompanied by a drawback in that they cannot prevent the ascent phenomenon where plate thicknesses are smaller than caliber dimensions. The above-described conventional various edger rolling methods are therefore believed to be extremely insufficient for the prevention of the buckling phenomenon and ascent phenomenon. Under the circumstances, there does not appear to be any specific means effective, especially for the prevention of the one-side ascent phenomenon.

With the foregoing in view, the present inventors analyzed the one-side ascent phenomenon of stock materials upon rolling the same by edgers and also conducted many experiments on plasticine models making use of experimental rolling mills. As a result of various analyses, it has been found that the one-side ascent phenomenon of stock materials upon their rolling by edgers are caused principally for the following reasons:

(1) non-uniformity in profile of a stock material at its side edges;

(2) widthwise tilting of a stock material due to widthwise inclination of a roller table adapted to convey the stock material; and (3) tilted arrangement of vertical rolls of an edger.

Among the above-mentioned causes, causes (2) and (3) may be removed by making improvements in the rolling facilities. Thus, it is possible to solve the one-side ascent phenomenon of stock materials by the thus-improved rolling facilities. With respect to the one-side ascent phenomenon induced by the profile of a stock material, it is necessary to know in detail the behavior of the stock material which behavior is attributed to the profiles of the side edges of the stock material upon its rolling.

Reference is now made to FIG. 1 which illustrates the cross-sectional profiles of stock materials schematically. As depicted in FIG. 1, stock materials may be classified into (a) stock materials (slabs) having deformed rectangularity or squareness in their widthwise cross-sectional profiles, (b) stock materials having asymmetric bulges formed upon their thickness-adjusting rolling (horizontal pass), and (c) stock materials having deformed or rolled diagonal corner portions. When rolling stock materials of these profiles by edgers, their materials are caused to flow due to plastic deformation of the stock materials induced by their widthwise rolling reduction. In each of the cross-sectional profiles of stock materials, the thicknesswise component of the flow of the material becomes greater, as shown in the drawing, at the corner portions A,A which are more protruded than the corner portions B,B. Accordingly, greater counter reactions are given against the material flow at the corner portions A,A by vertical rolls and the counter reactions produced against the material flow at the corner portions A,A and the corner portions B,B act as a couple force, thereby rotating the stock material. As a result, the stock materials are rotated in directions shown respectively by arrows in the drawing or, in other words, the stock materials are caused to develop one-side ascent.

As mentioned above, the causes (2) and (3) for the one-side ascent phenomenon may be successfully removed by making improvements in the rolling facilities. As trains of rough rolling mills suitable for use in the hot strip rolling process, there are known (1) the semi-continuous type, (2) the fully-continuous type, (3) the three quarter type, and so on. Whichever type is employed, a stock material S often develops as shown in FIG. 2 an upward bending deformation when exerted with a rolling force F by a pair of vertical rolls 1 upon the width-adjusting rolling in the course of its rough rolling. Accordingly, the stock material is rolled at its edge portions and deformation does not take place evenly in the widthwise direction of the stock material S. If the above-mentioned upward bending deformation should occur to an extreme degree, the width-adjusting rolling cannot be effected any further due to the buckling phenomenon of the stock material S. The buckling phenomenon is generally called "buckling". Accordingly, the width-adjusting rolling in the hot strip rolling process has heretofore been believed to be on the order of 50–60 mm or so at most.

It is to be further noted that the continuous casting technique has been finding more and more utility in recent years from the viewpoint of placing more importance on economy. It has also been attempted in various ways to combine continuous casting facilities with various steps of the hot strip rolling process and to thus achieve still further energy reduction and still higher productivity by subjecting continuously- cast slabs to hot charge rolling or direct shipment rolling, i.e., hot strip rolling. Since there is however a limitation imposed on the widthwise reduction rate in rough rolling as mentioned above, widthwise rolling passes are limited in trains of rough rolling mills of the above-mentioned types, especially when the fully-continuous type is employed. Accordingly, the above limitation acts to to a reduced production yield. It is also necessary to provide as continuously-cast slabs those having various dimensions conforming with the dimensions of final products so that the edger rolling, which constitutes the rear stage of the three quarter type, can be performed without failure to roll the widths of products with good accuracy. However, production of such slabs results in a reduction in the rate of operation of continuous casting facilities. Such also inhibits the above-mentioned continuation of the continuous casting step and hot strip rolling step. If an edger rolling method capable of providing a large widthwise rolling reduction can be applied to the rough rolling step in the hot strip rolling process, it is possible to conduct the widthwise rolling reduction successfully by means of a train of rough rolling mills. This enables setting slab dimensions, in other words, the widthwise dimensions of slabs in the aforementioned continuous casting facilities at some representative values. Therefore, it is possible to cut down the preparatory time required to change molds in accordance with changes in widthwise dimensions, thereby improving the rate of operation of continuous casting facilities. It is also feasible to combine the continuous casting step and the hot strip rolling step together into a continuous process.

It is a normal practice to conduct rolling by means of caliber rolls with a view toward achieving large widthwise rolling reductions upon rolling widthwise by the above-described vertical scale breakers or vertical roll. It is necessary to change the dimensions of the above-mentioned calibers as the thickness of each stock material varies in various ways. In order to have calibers follow variations in thickness dimensions of stock materials, edger rolls capable of changing their caliber dimensions have been proposed for example in Japanese Utility Model Publication No. 1881/1977. In each of such edger rolls, a sliding portion of one of its movable flange portions which constitute a caliber is worn out after its application over a prolonged period of time, thereby forming a gap in the sliding portion. Accordingly, a stock material may be bitten in the gap or the resulting sliding corner portion of the movable flange portion may leave press marks in the corresponding side edge of a stock material, resulting in defective products. In addition, a stock material undergoes the one-side ascent phenomenon or the like especially when an excessive rolling load is applied to the stock material upon its rolling by such edger rolls or the profiles of the side edges of the stock material are not uniform vertically. The one-side ascent phenomenon or the like then exerts a tremendous rolling counter force to the caliber adjustment mechanism. Accordingly, the above-mentioned caliber rolls are accompanied by a drawback that their caliber mechanisms become unavoidably complex if one wants to protect them from such tremendous rolling counter forces.

SUMMARY OF THE INVENTION

On the basis of the above-described findings, an object of this invention is to provide an edger rolling method which assures perpendicularity at the side edges of each stock material and permits effective prevention of not only the ascent phenomenon but also the buckling phenomenon of each stock material.

Another object of this invention is to provide a train of rough rolling mills for the hot strip rolling process, particularly, a continuous hot rolling mill suitable for application in the latter stage of a train of rough rolling mills of the fully automatic type or three quarter type, which continuous hot rolling mill assures perpendicularity at the side edges of each stock material and permits effective prevention of not only the ascent phenomenon but also the buckling phenomenon of each stock material.

A further object of this invention is to provide an edger roll of the variable caliber type, which may be suitably used in the practice of the above-mentioned edger rolling method or in the aforesaid continuous hot rolling mill.

In the first aspect of this invention, there is thus provided a method for rolling a plate-like stock material to a desired width on an edging stand of an edger, said edging stand being equipped with a pair of vertical rolls, which method comprises tilting the central axis of at least one of the vertical rolls of the edging stand within a suitable angle range toward the same direction as the advancing direction of the stock material or toward the direction opposite the advancing direction of the stock material in a vertical plane parallel to the advancing direction of the stock material.

In a second aspect of this invention, there is also provided a continuous hot rolling mill including vertical rolling mills and horizontal rolling mills arranged one after another so as to reduce the thickness of each stock material while edging the same, in which continuous hot rolling mill each of the vertical rolling mills is arranged with the axis of at least one of its rolls tilted in the direction opposite the advancing direction of the stock material in a vertical plane parallel to the advancing direction of the stock material.

In a third aspect of this invention, there is further provided an edger roll of the variable caliber type, said edger roll including a pair of flange portions formed thereon, in which edger roll one of the flange portions is formed on a rotatably-supported roll shaft, the other flange portion is movably fit in the direction of the central axis of the roll shaft and is rotatable relative to the former flange portion, and when assembled in an edger, the roll shaft is tilted in a vertical plane parallel to the advancing direction of each stock material.

The above rolling method, continuous hot rolling mill and edger roll are effective in ensuring the perpendicularity at the side edges of each stock material and permitting effective prevention of not only the ascent phenomenon but also the buckling phenomenon of each stock material.

The above and other objects, features and advantages of the present invention will become apparent from the following description and the appended claims, taken in conjunction with the accompanying drawings.

DETAILED DESCRIPTION OF THE PREFERRED EMBODIMENTS

Figure 1A:
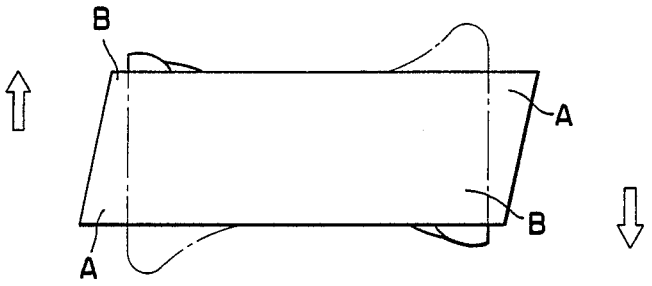
FIG. 1(a) PRIOR ART
FIG. 1 is a schematic illustration showing the cross-sectional profiles of stock materials.
Figure 1B:
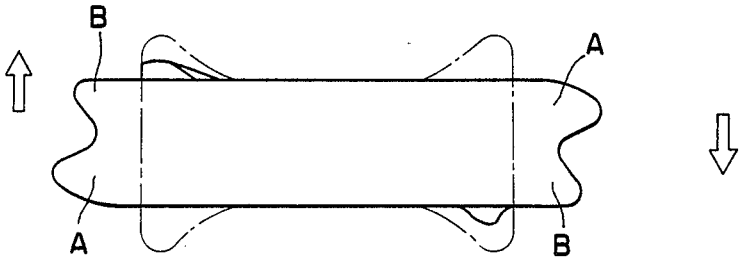
FIG. 1(b) PRIOR ART
Figure 1C:
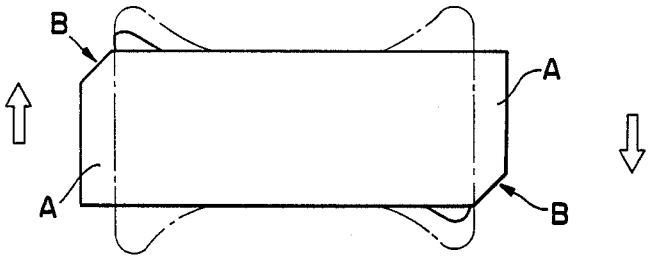
FIG. 1(c) PRIOR ART
Figure 2:
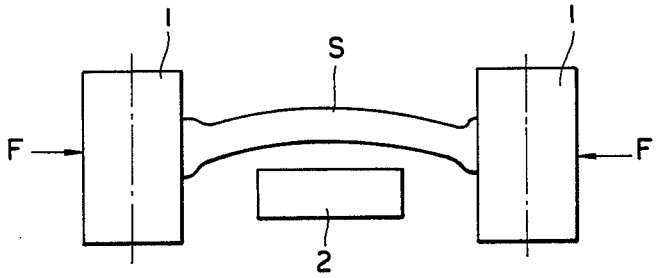
FIG. 2 PRIOR ART
FIG. 2 is a schematic illustration showing a state of rolling by a conventional edger.
Figure 3:
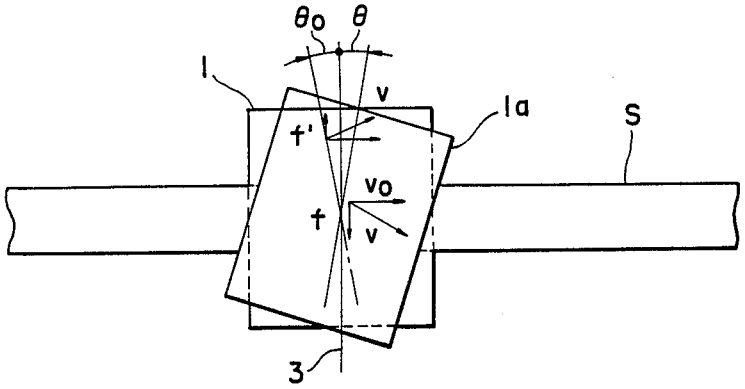
FIG. 3 to FIG. 5 depict schematically an edger rolling method according to one embodiment of the first aspect this invention.
Figure 4:
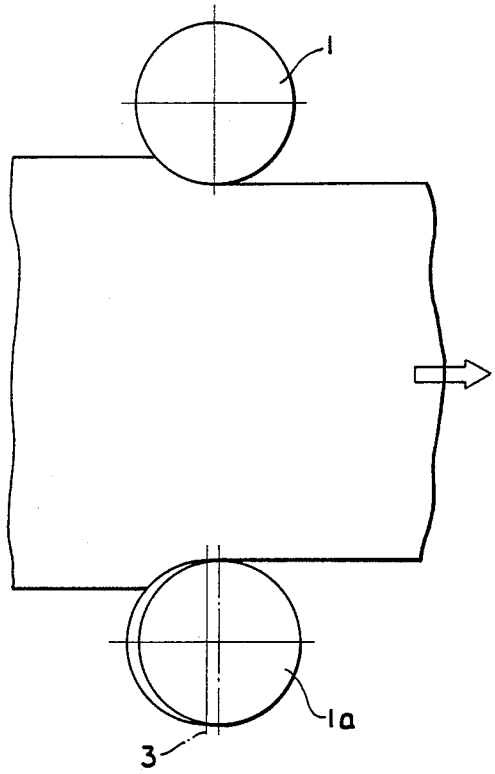
Figure 5:
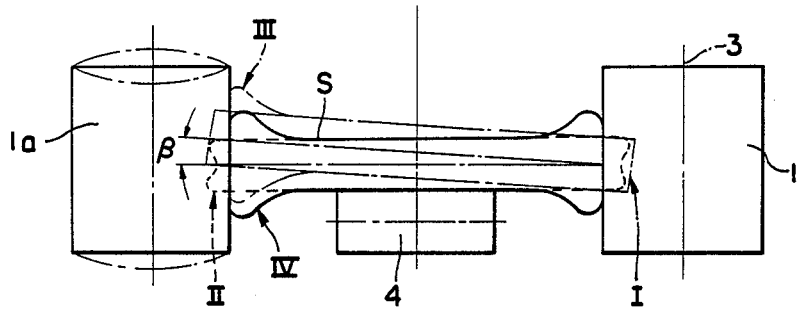

FIGS. 3 to 5 illustrate the outline of an edger rolling method according to the first embodiment of the first aspect of this invention. A stock material S is subjected to widthwise rolling, in other words, edger rolling by using a pair of vertical flat rolls 1, 1*a*. When performing edger rolling, development of the ascent phenomenon in the stock material S in the course of its rolling operation is detected by an operator or making use of a adetector or the like. Then, either one or both of the paired vertical rolls are tilted over a suitable angle $\theta°$ formed with a plane 3 perpendicular to the advancing direction and in the same direction as the advancing direction of the stock material S or in the direction opposite the advancing direction of the stock material S in a vertical plane parallel to the advancing direction of the stock material S. Describing such in greater detail, when the stock material S is brought into bitten engagement at an angle $\beta$ with respect to a plane horizontal to the vertical roll 1 (indicated by "I" in FIG. 5) or the stock material S having such side edge profiles as shown in FIG. 1(*b*) (indicated by "II" in FIG. 5), which profiles have been formed due to non-uniform double bulging in its thickness-adjusting rolling operation (horizontal pass), develops the ascent phenomenon due to its material flow (indicated by "III" in FIG. 5), the vertical roll at which the stock material has developed the ascent, for example, the axis of rotation of the vertical roll 1*a* is tilted over the angle $\theta°$ in a vertical plane parallel to the advancing direction of the stock material S. As a result, rotation force $v$ is produced by the rotation of edge roll 1*a*, $v$ is produced as a horizontal component of $v$, and a holding force f is produced as a vertical component of $v$ for the stock material S as illustrated in FIG. 3. This holding force f removes or suppresses the ascent phenomenon of the stock material, thereby permitting normal rolling (indicated by "IV" in FIG. 5). According to various experiments, it has been confirmed that the tilting of the vertical roll 1*a* can bring about significant effects even when its tilt angle is rather small, namely, ranging from 1.5° to 5°. When this ascent phenomenon takes place to a significant extent and the tilting of only one of the vertical rolls, i.e., the vertical roll 1*a* cannot prevent the ascent phenomenon, it is effective to tilt the other vertical roll 1 which is located adjacent to the other side edge of the stock material S opposite to its ascending side edge over a suitable angle $\theta°$ in the direction opposite to the advancing direction of the stock material S. Namely, this tilting of the vertical roll 1 produces the composition of a kinetic vector in the direction opposite to the kenic vector produced by the vertical roll 1*a*, thereby producing an anti-gravity force f'. Accordingly, the holding force f and anti-gravity f' are produced respectively by the vertical rolls 1, 1*a*.

These two forces act in such a way that they maintain the attitude of the stock material S horizontal as a whole, thereby making it possible to avoid the ascent phenomenon of the stock material and to perform width-adjusting rolling to a sufficient extent on the stock material. It is readily understood that the perpendicularity of each of the side edges of the stock material S is fully maintained because the vertical rolls 1,1*a* are tilted in vertical planes parallel to the advancing direction of the stock material S.

In the above explanation, the cylindrical vertical rolls 1,1a were tilted after the ascent phenomenon of the stock material S had been detected by the vertical rolls 1,1*a*. It is also possible to prevent the ascent phenomenon by tilting the vertical rolls 1,1*a* at a suitable angle $\theta$ in the advancing direction of the stock material within vertical planes parallel to the advancing direction of the stock material and exerting holding forces f to both side edges of the stock material. The present invention can obviously be applied even when the thickness of a stock material is smaller than the caliber dimension when the width-adjusting rolling of the stock material is carried out by vertical rolls equipped with calibers.

The outline structure of a rolling mill useful in the practice of the edger rolling method according to the first embodiment of the first aspect of this invention will next be described with reference to FIG. 6 to FIG. 8. It should however be borne in mind that the following description imposes no limitation on the present invention but pertains merely to a preferred embodiment. In the illustrated embodiment, the structure of only one half side of a vertical edger is shown in order to facilitate its understanding. The other half side has of course the same structure.

Numeral 10 indicates a housing of the vertical edger, on which a frame 11 is mounted movably back and forth in the widthwise direction of the stock material, for example, by way of wheels 12 which roll round on the housing 10. The back face of the frame 11 is connected to rolling screws 14 of rolling mechanisms 13 mounted on the housing 10 and formed of worm screws. A vertical roll 15 is rotatably supported on a clock 16, which is in turn fittingly supported by a stepped portion 18 of an upwardly-opening boss 17 provided rotatably with the frame 11. On the other hand, the upper portion of the vertical roll 15 is supported by pistons 20 of cylinders 19 provided in the inner wall of the frame 11 in such a way that they confront each other in the advancing direction of the stock material. Therefore, the vertical roll 15 is constructed into such a structure that it is tiltable in accordance with actuation of the cylinders 19 in the same direction as the advancing direction of the stock material or in the direction opposite the advancing direction of the stock material within a vertical plane parallel to the advancing direction of the stock material. Although not illustrated in the drawings, the vertical roll 15 can be driven in the same manner as conventional vertical rolls.

In the above-mentioned vertical edger, edger rolling is carried out by actuating the rolling mechanisms 13 to move the rolling screws 14 and applying a desired rolling force to the vertical roll 15. If the stock material develops ascent in the course of its rolling, the central axis of the vertical roll 15 is tilted in the same direction as the advancing direction of the stock material within the vertical plane parallel to the advancing direction of the stock material. Supposing now that the stock material is advancing rightward in FIG. 7, the vertical roll 15 is rotated owing to the action of the boss 17, which supports the lower extremity of the vertical roll 15, and is tilted over the desired angle $\theta$ in the advancing direction of the stock material, i.e., rightward when the left-hand cylinder 19 is actuated and the chock 16 of the vertical roll 15 is pressed by the piston 20. This tilting of the vertical roll 15 produces the holding force f against the stock material as described above, thereby permitting stable rolling without development of the ascent phenomenon. When the rolling operation is carried out in the direction opposite to the above-mentioned rolling direction, the right-hand cylinder 19 is actuated conversely to the above-described rolling operation, and the rolling operation is carried out while keeping the vertical roll 15 tilted leftward.

As apparent from the above description, the edge rolling method according to the first embodiment of the first aspect of this invention can prevent each stock material from ascending by tilting at least one of the paired vertical rolls at a suitable angle in the same direction as the advancing direction of the stock material or in the direction opposite the advancing direction of the stock material within a vertical plane parallel to the advancing direction of the stock material. In addition, the above method can maintain the perpendicularity of the corresponding side edge of the stock material because the vertical roll is tilted within the vertical plane. Moreover, the above method permits a stable rolling operation and hence improves the widthwise dimensional accuracy further. Accordingly, the edge rolling method according to the first embodiment of the first aspect of this invention can bring about significant commercial advantages.

Figure 11:
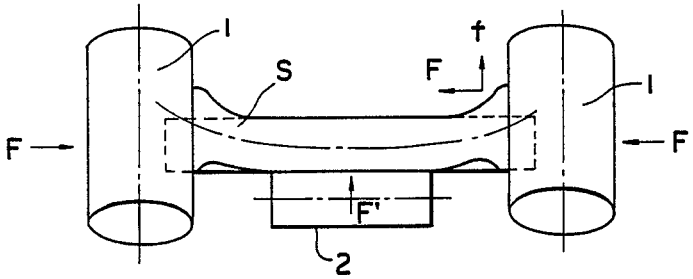
FIGS. 9 to 11 are schematic illustrations of an edger rolling method according to the second embodiment of the first aspect this invention.
Figure 9:
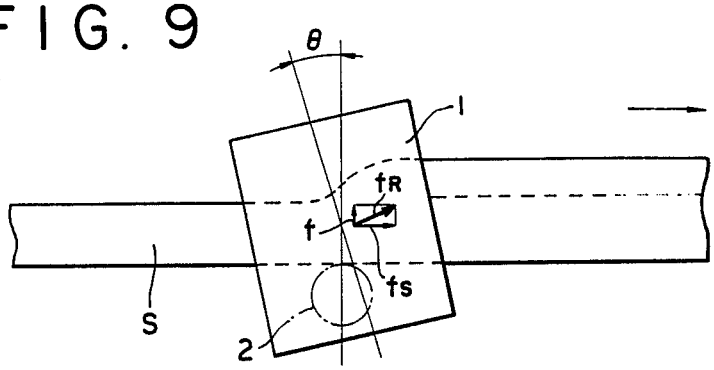
Figure 10:
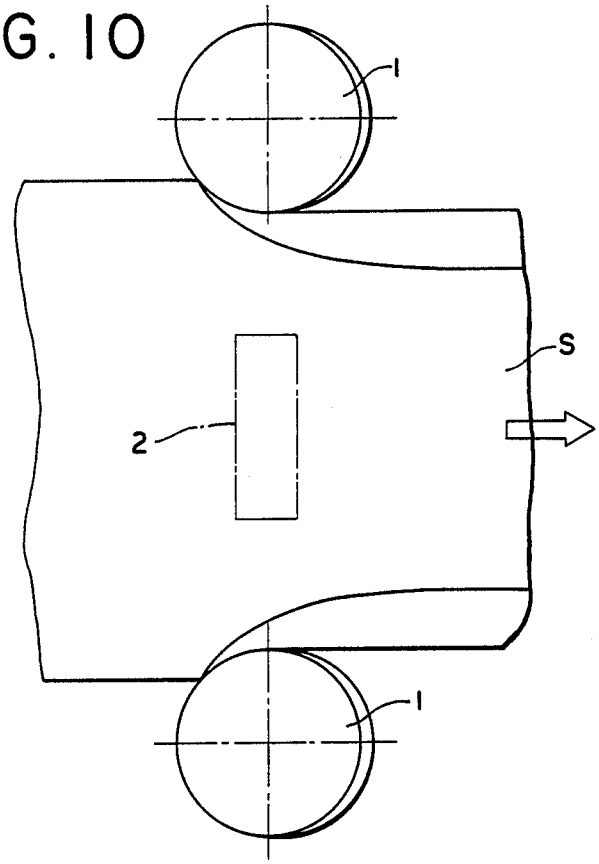

An edger rolling method according to the second embodiment of the first aspect of this invention will next be described. FIG. 9 to FIG. 11 illustrate schematically the principal of the edger rolling method. A pair of vertical rolls 1,1 having smooth surfaces is in advance tilted at a suitable angle $\theta°$ in the direction (i.e., toward the incoming side of each stock material S) opposite the advancing direction (indicated by an in FIG. 10) of the stock material. The stock material S is brought into bitten engagement with the thus-tilted vertical rolls, 1,1. The stock material S which has been brought into bitten engagement with the vertical roll 1,1 is rolled widthwise as rolling loads F are exerted on the stock material S from the vertical rolls 1,1. Since the vertical rolls 1,1 are arranged aslant relative to their corresponding side edges of the stock material S, an upward anti-gravity force is applied to each of side edge portions of the stock material S as a result of a kinetic vector in the rotating direction of its corresponding vertical roll 1. Thus, upward deformation occur at both side edge portions of the stock material S. Then, these upward deformations cause the point of action of the rolling load F to the stock material S to shift, thereby producing a bending moment. This bending moment thereafter develops a downwardly-bent deformation. This downwardly-bent deformation of the stock material S is brought into contact with a table roller 2 disposed between the vertical rolls 1, thereby supporting the stock material S by virtue of a counter force. The bending moment applied to the stock material S, which moment has been developed by the rolling load F upon rolling same to adjust its width, is then balanced with the counter force. In other words, the development of buckling can be converted to ascent-suppressing means by controlling the direction of deformation and balancing the deformation with the table roller 2 upon buckling the stock material S. The width-adjusting rolling is carried out in the above-mentioned manner.

Figure 12:
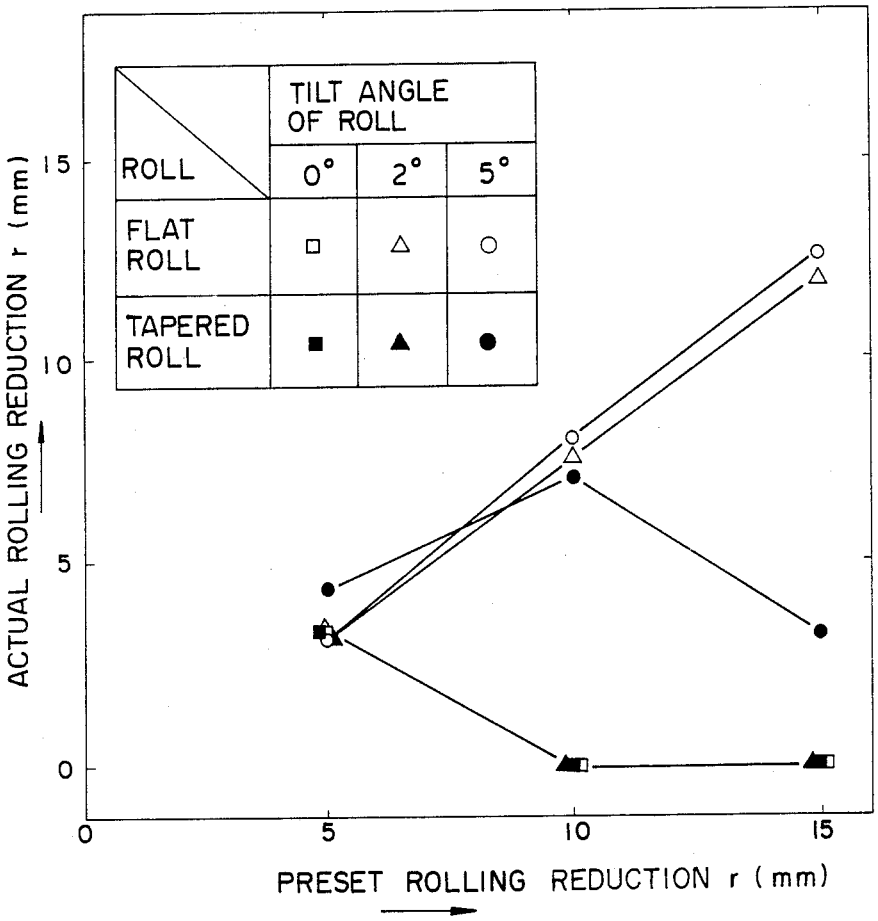
FIG. 12 is a graphic representation illustrating some experimental results to show widthwise rolling effects of this invention.

FIG. 12 shows diagrammatically results of an experiment conducted using plasticine models. As stock materials S, there were employed flat plasticine plates each of which was 10 mm thick and 150 mm wide and had been cooled to 0°. As vertical rolls, there were used flat rolls and tapered rolls. The tapered rolls had conventionally been said to be effective for the prevention of buckling and were imparted with a tilted surface of 5°. Rolling of the stock materials S was effected by changing the tilt angles $\theta$° of the vertical rolls to the levels of 0°, 2° and 5° while at the same time, varying the rolling reduction to 5 mm, 10 mm and 15 mm.

In FIG. 12, preset rolling reductions $\gamma$ (mm) are plotted along the horizontal axis whereas actual rolling reductions $\gamma'$ (mm) are plotted along the vertical line. As apparent from the results given in FIG. 12, no differences were developed in effects when the rolling reduction was small (5 mm). However, buckling was developed and widthwise rolling was not effected to any substantial extent without exception whenever the preset rolling reduction was more than 10 mm except that the flat rolls were tilted by 2° or 5° or the tapered rolls were tilted by 5°. When the rolling reduction was preset at 15 mm, it is readily envisaged that even when the tapered rolls were tilted by 5°, buckling was developed and the widthwise rolling was not effected to any significant extent. On the other hand, use of the flat rolls allowed for achievement of the widthwise rolling to a sufficient extent. In other words, it is recognized from these results that the edger rolling method according to the second embodiment of the first aspect of this invention can exhibit its effect to the maximum extent when performing large widthwise rolling.

Figure 13:
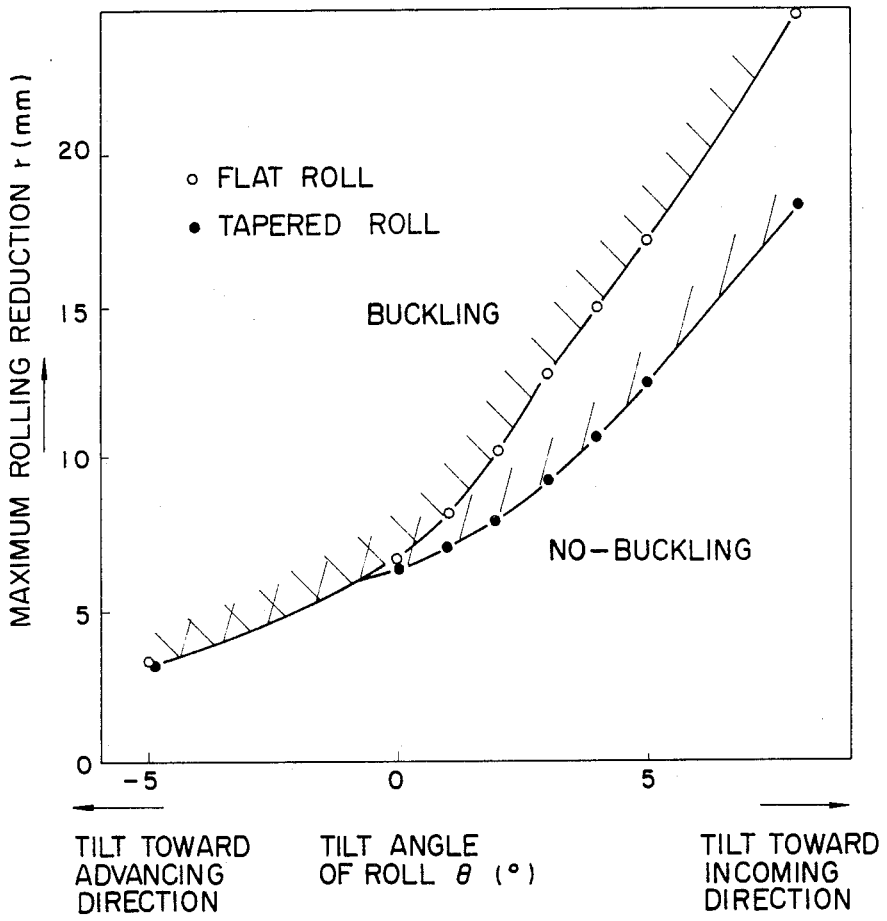
FIG. 13 diagrammatically illustrates experimental results showing the effect of vertical rolls, which are tilted in accordance with the second embodiment of the first aspect this invention, on the rolling reduction.

In FIG. 13, the influence of tilt angles of the vertical rolls which were tilted in accordance with the second embodiment of the first aspect of this invention on widthwise rolling reduction is shown in terms of the relationship between the tilt angles and their corresponding rolling reductions which induced buckling. As readily envisaged from these results, it is understood that the maximum rolling reduction which does not cause buckling increases as the tilt angle becomes greater.

In the above explanation, vertical rolls having smooth surfaces were tilted in the direction opposite the advancing direction of each stock material (i.e., toward the incoming direction of the stock material) prior to effecting its widthwise rolling. However, stock materials may develop the ascent phenomenon in some instances upon their widthwise rolling. It may be assumed that the ascent phenomenon can be prevented by holding down side edge portions of each stock material at the positions of its bitten engagement by virtue of the pressing forces of the vertical rolls per se because the vertical rolls are tilted toward the incoming direction of the stock material. However, this effect of the vertical rolls may not be fully brought about and the ascent phenomenon may hence be developed depending on the tilt angles of the vertical rolls, for example, when the tilt angles are small. Even if such a problem arises, it has been found that the ascent phenomenon can be successfully avoided by adjusting the tilt angle of one of the vertical rolls, namely, the tilt angle of the vertical roll where the stock material has developed the ascent phenomenon. For example, when the ascent phenomenon cannot be solved even after changing the tilt angle of the vertical roll where the stock material has developed the ascent phenomenon little by little to 0°, in other words, after allowing the vertical roll to regain its vertical position, it may still be possible to avoid the ascent phenomenon by tilting the vertical roll further toward the advancing direction of the stock material. The present invention can obviously be applied even when the thickness of a stock material is smaller than the caliber dimension when the width-adjusting rolling of the stock material is carried out by vertical rolls equipped with calibers.

Figure 6:
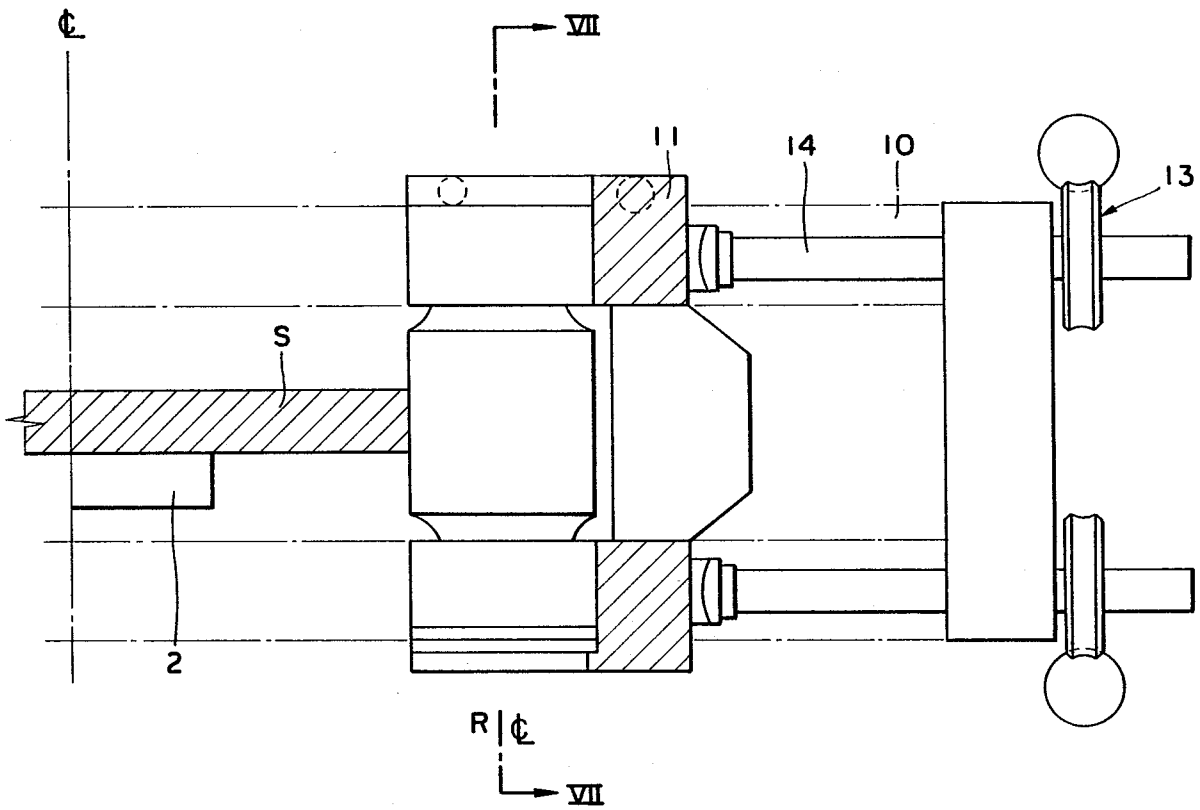
FIG. 6 is a simplified fragmentary front elevational view of a vertical edger suitable for use in practicing the edger rolling method.
Figure 7:
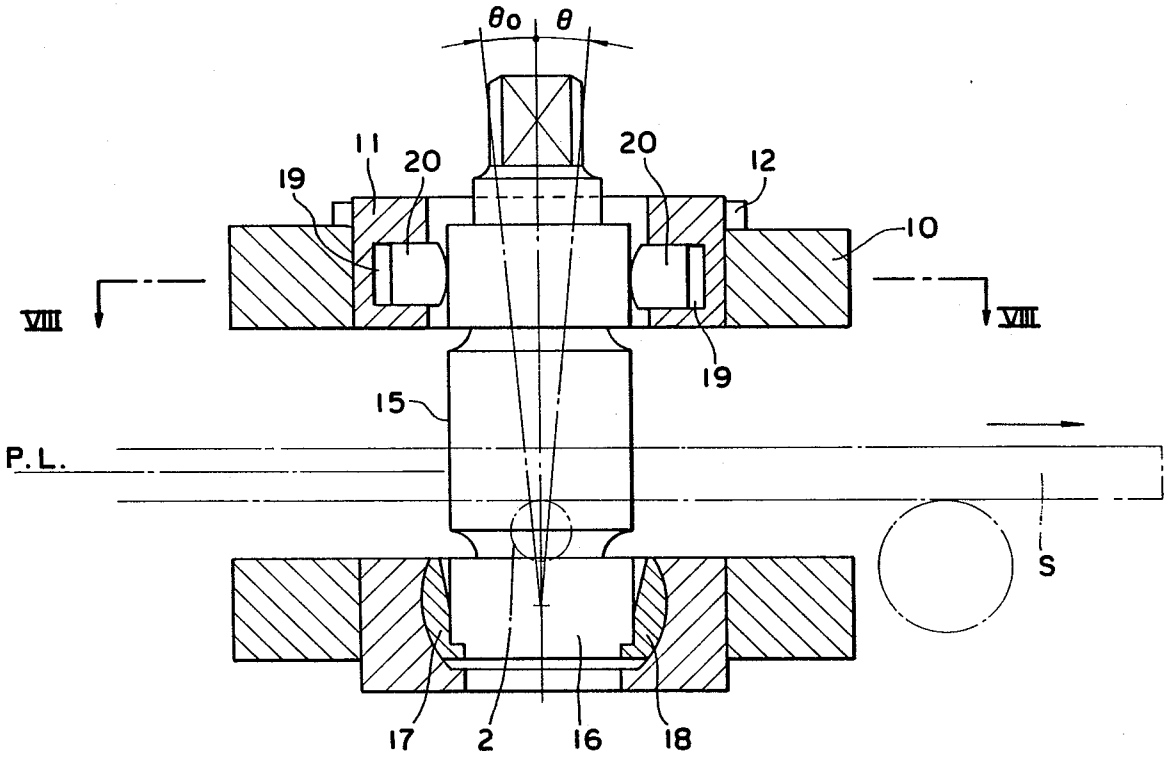
FIG. 7 is a vertical cross-sectional view taken along line VII—VII of FIG. 6.
Figure 8:
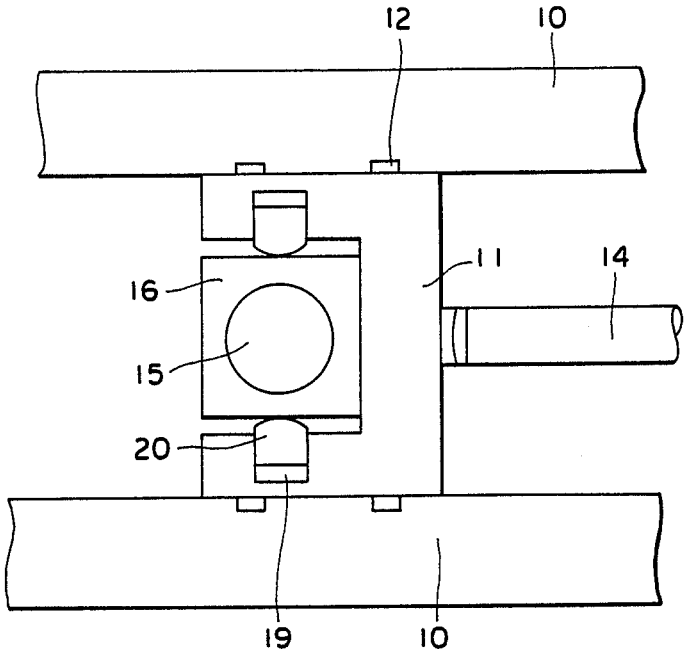
FIG. 8 is a horizontal cross-sectional view taken along line VIII—VIII of FIG. 7.

Referring next to FIG. 6 to FIG. 8, a further description will be made on the outline structure of a rolling mill suitable for use in the practice of the rolling method according to the second embodiment of the first aspect of this invention. The rolling mill is basically identical to that employed for practicing the rolling method according to the first embodiment of the first aspect of this invention, except for the provision of the table roller 2 disposed between the paired vertical rolls 15.

In the above-mentioned vertical edger, a desired rolling reduction is exerted to the vertical roll 15 by actuating the rolling mechanisms 13 and moving the rolling screws 14. At the same time, the vertical roll 15 is tilted in the direction opposite the advancing direction of the stock material within the vertical plane parallel to the advancing direction of the stock material. Supposing now that the stock material is advancing rightward in FIG. 7, the vertical roll 15 is rotated owing to the action of the boss 17, which supports the lower extremity of the vertical roll 15, and is tilted over the desired angle $\theta$ toward the incoming direction of the stock material, i.e., in the direction opposite the advancing direction of the stock material S, in other words, leftward in the drawing when a hydraulic pressure is applied to the rod-side compartment of the left-hand cylinder 19 in the frame 10 to cause its corresponding piston to advance and the chock 16 of the vertical roll 15 is pressed by the piston 20. The width-adjusting rolling operation is carried out while maintaining the vertiacl roll in the above-mentioned state. When the rolling operation is carried out in the direction opposite to the above-mentioned rolling direction, the left-hand cylinder 19 is actuated conversely to the above-described rolling operation, and the rolling operation is carried out while keeping the vertical roll 15 tilted rightward.

When the stock material S has developed the ascent phenomenon and its width-adjusting rolling has been rendered difficult in the course of its rolling, the stock material S can be prevented from the ascent phenomenon by actuating the left-hand cylinder 19 to adjust the tile angle $\theta$ of the vertical roll 15 where the ascent phenomenon has occurred and for example, by changing the tilt angle $\theta$ of the vertical roll 15 back to 0°, i.e., to its vertical position or by tilting the vertical roll 15 further rightward i.e., in the same direction as the advancing direction of the stock material to a suitable angle as mentioned above.

The edger rolling method according to the second embodiment of the first aspect of this invention can remove the limitation to the widthwise dimension of each stock material and owing to the successful prevention of bucking, it can improve the widthwise dimensional accuracy. Accordingly, the above edger rolling method can bring about such advantageous effects as an improved production yield, thereby making significant contribution from the industrial standpoint.

Referring next to FIGS. 14–18, an edger rolling method according to the third embodiment of the first aspect of this invention will be described.

Figure 14A:
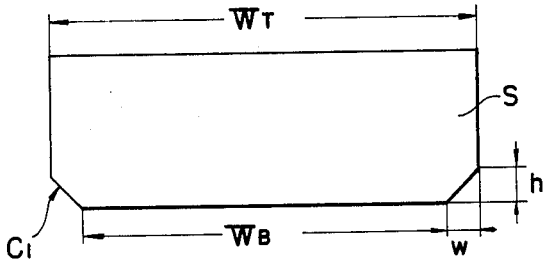
FIG. 14 is a cross-sectional view showning the widthwise cross-sectional profile of a stock material to which an edger rolling method according to the third embodiment of the first aspect this invention may be applied.
Figure 14B:
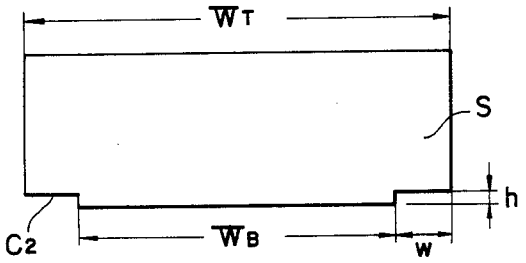
Figure 14C:
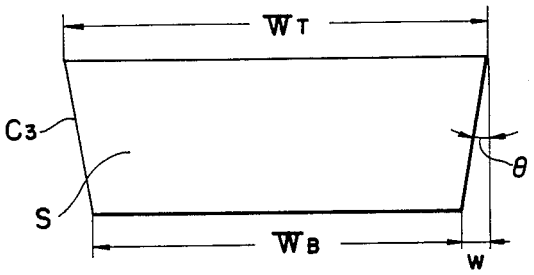

The one-side ascent phenomenon of a stock material is heavily affected by flow of the material making up the stock material. This material flow is in turn governed by the profiles of side edges of the stock material. A suppression force which is developed as a counter action to the material flow is used as a force which prevents the stock material from ascending. From this viewpoint, the profiles of side edges of a stock material is modified as shown by way of example in FIG. 14, to thereby intentionally render the material flow different vertically in the stock material. Namely, the stock material is cut off at its lower corner portions $C_1$ over a thickness h and width w along both side edges thereof as shown in FIG. 14(*a*). Alternatively, as depicted in FIG. 14(*b*), stepped portions $C_2$ are formed each with a thickness h and width w. Furthermore, tapered faces $C_3$ may be formed at an angle $\theta$ to a suitable width w as illustrated in FIG. 14(*c*) so that so-called chamfered portions C are formed along both lower side edges of the stock material S. Whichever cross-sectional profile a stock material S is formed into, the cross-sectional profile of the stock material S is machined prior to subjecting it to width-adjusting rolling by vertical rolls so as to establish the following relationship:

$$W_T > W_B$$

where $W_T$: upper widthwise dimension of the stock material, $W_B$: lower widthwise dimension of the stock material. Here, a variety of methods may be contemplated to perform the chamfering machining of the stock material. For example, there may be mentioned gas scarfing, press forming, cutting, rolling and so on. A suitable method may be chosen in view of such conditions as production cost and equipment cost.

Figure 15A:
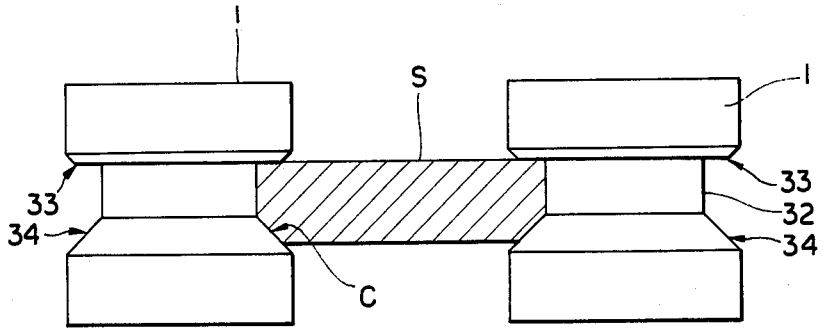
FIG. 15(*a*) and FIG. 15(*b*) are schematic illustrations showing forming, i.e., machining examples.
Figure 15B:
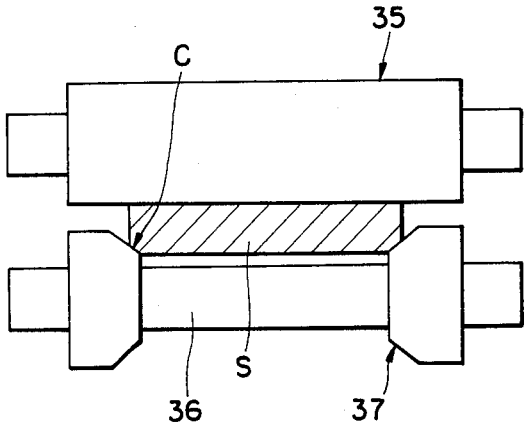

Chamfering machining making use of rolling is now described by way of example with reference to FIG. 15(*a*). Namely, the stock material S is machined and formed by an edger rolling mill equipped with calibers. Vertical rolls 1,1 which are provided as a pair with the stock material S interposed therebetween define calibers 32. Each of the calibers 32 is defined at its upper end by a side wall 33 which lies in a horizontal plane parallel to a pass restraining the upper face of the stock material S and at its lower end by a tilt side wall 34 adapted to form the chamfered portion C in the stock material S. The chamfered portions C are formed and machined by rolling the stock material S from both sides thereof by means of the vertical rolls 1,1. Reference is next made to FIG. 15(*b*), where the chamfered portions C are formed and machined between rolling rolls provided in a pair in up-and-down relationship with the stock material S interposed therebetween. Namely, the chamfered portions C of the stock material S are formed between a pair of rolls, one being a flat cylindrical upper roll 35 and the other a stepped roll 36 defining tilted faces 37 at both end portions thereof.

Figure 16:
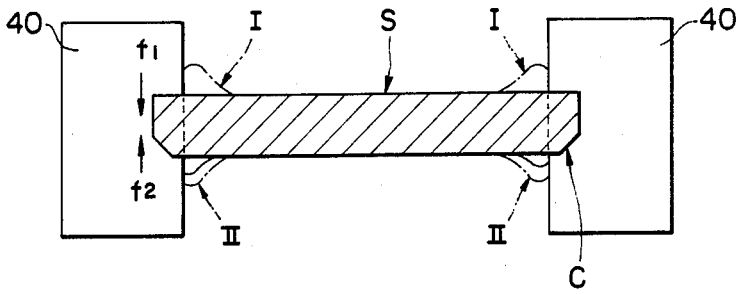
FIGS. 16 through 18 are schematic illustrations showing the course of deformation of a stock material when the edger rolling method according to the third embodiment of the first aspect this invention is applied thereto.
Figure 17:
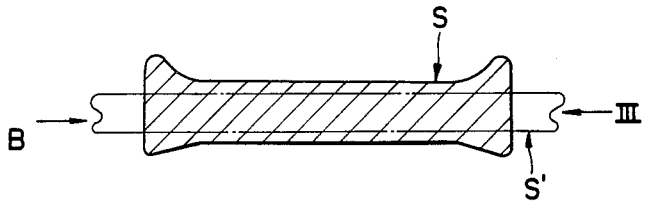
Figure 18:
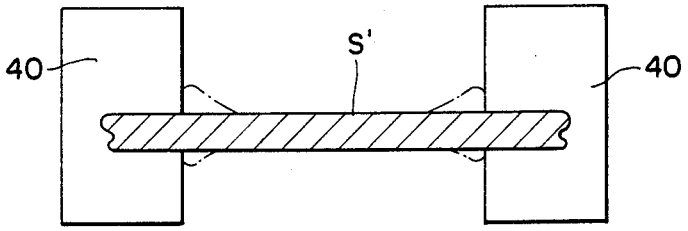

When the stock material S defining chamfered portions C formed and machined in advance in the manner mentioned above is subjected to width-adjusting rolling by means of a pair of vertical rolls 40,40 arranged side by side with the stock material S interposed therebetween, the material flow in the upper corner portions of the stock material S differs from that in the lower corner portions of the same stock material S as depicted in FIG. 16. Accordingly, upper dog-bone portions I,I are caused to bulge much greater than lower dog-bone portions II,II. At this stage, loads $f_1$,$f_2$ applied as counter forces against the material flow to the stock material S from the vertical rolls 40 become smaller at chamfered portions C. The resulting suppression force acts on the stock material S as a force pressing the stock material S against a roller table conveyor. As a result, the stock material S can be prevented from ascending. Following the width-adjusting rolling by means of the vertical rolls 40, thickness-adjusting rolling may be conducted by means of horizontal rolls. As depicted in FIG. 17, the resulting rolled material S′ carries double bulges III formed at both side edges thereof. Since there is a difference in size between each dog-bone portion I and its corresponding dog-bone portion II formed in the preceding width-adjusting rolling step, each of the bulges III protrudes to a greater extent along the upper side edge. As a result, the side edges of the rolled material S′ are not even. When such a rolled material S′ is subjected to further width-adjusting rolling as shown in FIG. 18, a difference is also developed in the flow of the material of the rolled material S′ in much the same way as described with reference to FIG. 16. Owing to this difference, the rolled material S′ can be successfully prevented from ascending. Similar procedures are repeated in the subsequent edger rolling. It is however possible to perform stable and smooth width-adjusting rolling by intentionally forming and machining chamfered portions along both lower side edges of each stock material by such means as shown in FIG. 15 or FIG. 16 prior to its width-adjusting rolling by vertical rolls in each stage so as to ensure the prevention of ascending of the stock material S.

As apparent from the above explanation, the edger rolling method according to the third embodiment of the first aspect of this invention applies advance chamfering machining to both lower side edges of each stock material or rolled material which is to be subjected to width-adjusting rolling by veritcal rolls, thereby avoiding the ascent phenomenon of the stock material or rolled material. Therefore, such can effect each width-adjusting rolling operation to a sufficient extent and at the same time, can improve the widthwise dimensional accuracy. Furthermore, such can minimize edges which have to be trimmed away after the rolling. Accordingly, the edger rolling method according to the third embodiment of the first aspect of this invention can bring about a significant contribution to the industry, including an improved production yield.

Figure 19:
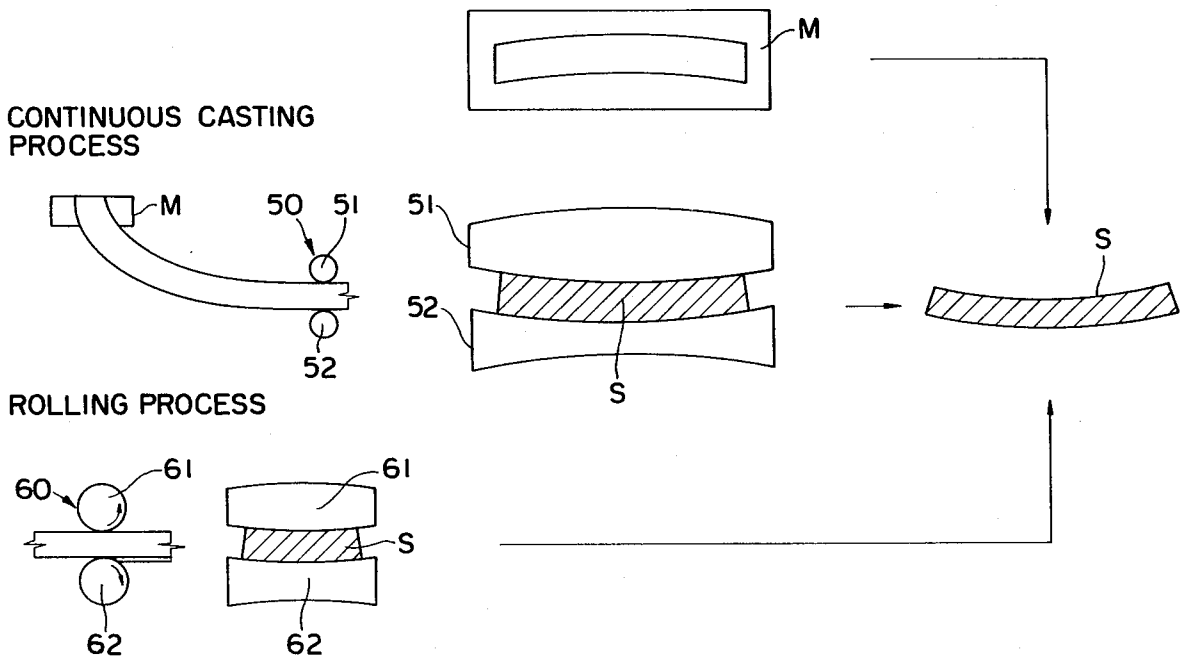
FIG. 19 is a schematic illustration showing the production process of a rolled material in an edger rolling method according to the fourth embodiment of the first aspect this invention.

It has also been found that the material flow of each stock material may be effectively used to prevent the stock material from ascending provided that the stock material is somewhat downwardly bulged out. On the basis of the above finding, an edger rolling method according to the fourth embodiment of the first aspect of this invention has been completed. In the fourth embodiment, it is necessary to form each stock material S in such a way that the stock material S will have a widthwise cross-sectional profile which is downwardly bulged out. As shown in FIG. 19 by way of example, when a continuously cast slab is used as a stock material, it is possible to conduct the casting of the slab by means of a mold, the slab-defining walls of which are formed into arcuate shapes so as to impart prescribed curvatures to the widthwise cross-sectional profile of the resulting slab, as a mold M of a continuous casting machine or to form a slab S by after completion of solidification of a cast ingot, rolling the cast ingot by means of a forming roll 50 which is composed of a convex roll 51 bulged out at its longitudinal central portion and a concave roll 52 curved in at its longitudinal central portion. In the blooming process or in the rough rolling step of the hot strip rolling process, the slab S may be formed by rolling a stock material by means of a roll-forming mill 60 which is composed of a convex rol 61 and a concave roll 62.

Figure 20:
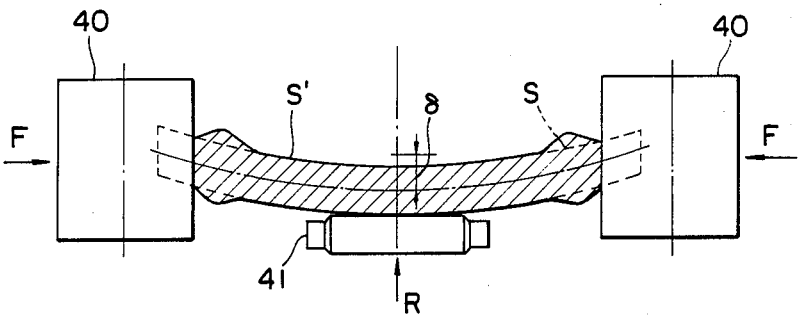
FIGS. 20 and 21 schematically illustrate the edger rolling method according to the fourth embodiment of the first aspect this invention.
Figure 21:
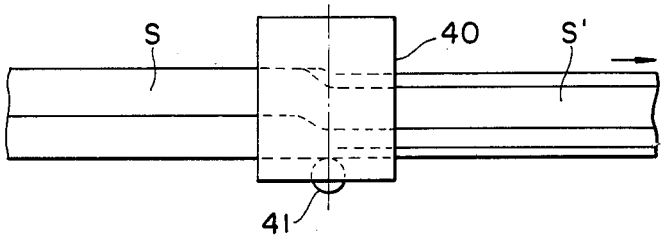

Next, a further description will be made with respect to the manner of applying width-adjusting rolling (i.e., edging) to a stock material which has been formed to have a downwardly-bulged widthwise cross-sectional profile. The rolling state of an edger is schematically shown in FIG. 20 and FIG. 21, in which the stock material S which is to be fed to the paired vertical rolls 40,40 has been formed to have a downwardly-bulged widthwise cross-sectional profile in the preceding step as described above. When rolling loads F are exerted widthwise to the thus-bent stock material S between the paired vertical rolls 40, a difference, i.e., a mismatch $\delta$ occurs between the point of action of each rolling load F on its corresponding end face of the stock material S and the center of the stock material S on the table roller 41 on which the stock material S is supported as apparent from FIG. 20 because the stock material S is bent. When the stock material S is fed between the vertical rolls 40,40 and the widthwise loads F,F are applied to the stock material S, the stock material S develops a bending moment in the presence of the aforementioned mismatch $\delta$ and undergoes further downward bending deformation. Since the lower face of the stock material S is kept restrained by the table roller 41 disposed between the vertical rolls 40,40, the stock material S is however held between the paired vertical rolls 40,40 while making use of table roller 41 as a fulcrum. In other words, the deformation load as the bending moment of the stock material S is balanced with a counter force R developed by the table roller 41. In this state, the stock material S is edged. Since it is restrained by the vertical rolls 40,40 and table roller 41, it is possible to impart great edging to the stock material S. Moreover, this edging can be carried out without developing any excess deformation in the stock material S.

Although this width-adjusting rolling reduction is dependent on the degree of curvature of the stock material S, in other words, its curvature (radius), the curvature of the stock material S is determined in view of the extent of its bitten engagement with horizontal rolls upon subjecting the thus-edged stock material to thickness-adjusting rolling subsequent to the width-adjusting rolling. From the viewpoint of edger rolling, it does not appear to be necessary to enlarge the curvature of the stock material S to any considerable extent.

Figure 23:
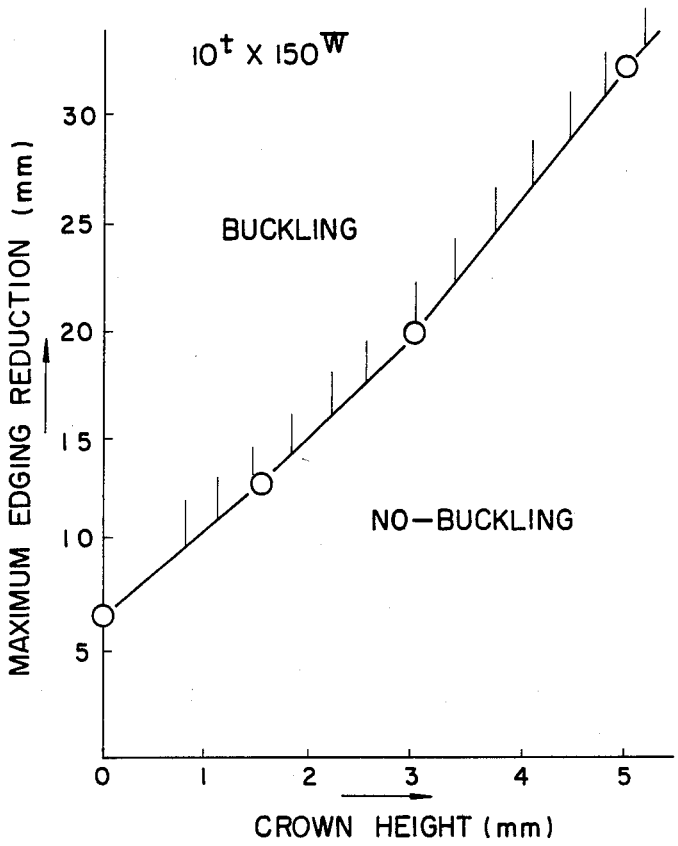
FIG. 23 is a graphic representation of data obtained as a result of an experiment.

FIG. 23 shows results of an experiment which was conducted using plasticine to determine the relationship between the curvature of the stock material S and the maximum edging reduction.

As sample stock materials S, there were used stock materials each of which was 10 mm thick (equivalent to 100 mm as an actually-rolled material) and 150 mm wide (equivalent to 1500 mm as an actually-rolled material). Edging reductions were measured by varying their curvatures in various ways. In order to facilitate the understanding of the curvature of each stock material, the crown heights of concave rolls or convex rolls which were employed to form the stock materials are plotted along the abscissas.

As apparent from these results, it is possible to achieve a rolling reduction as great as 300–400% compared with conventional edger rolling even when a slight curvature is imparted to the stock material S. Therefore, the downward bulge can bring about extremely large effects to the edging reduction. In other words, it is possible to reduce the number of passes required to achieve a desired level of edging reduction. It is also understood that the ratio of the widthwise dimension of each stock material to that of a resulting rolled product may be rendered shorter owing to the increased edging reduction.

Figure 22:
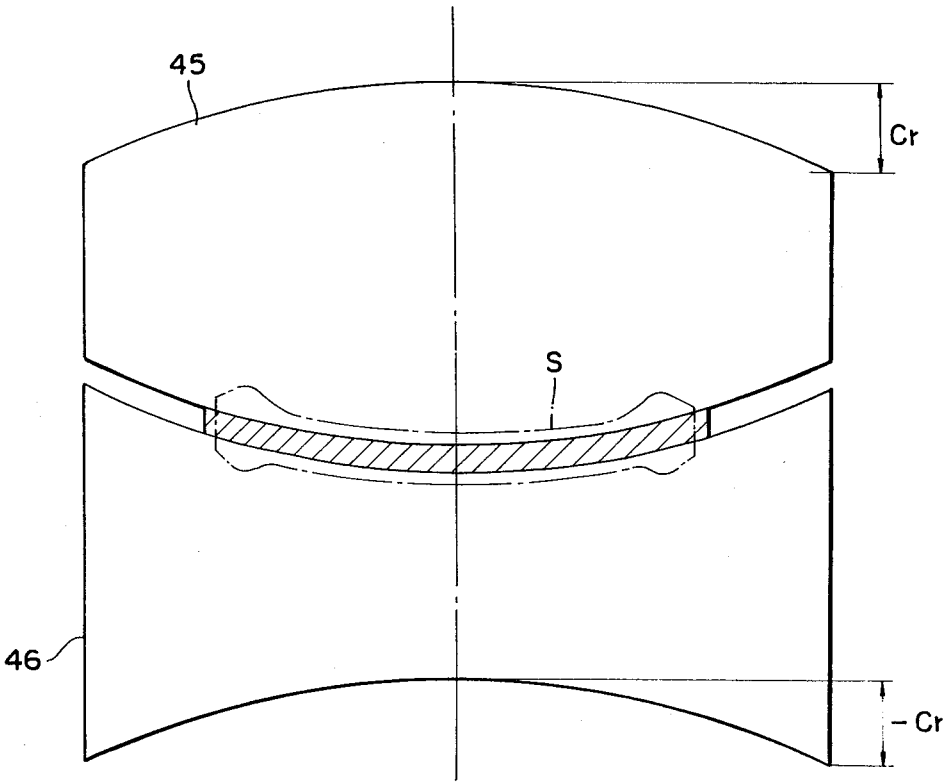
FIG. 22 is a schematic illustration of rolling of a material which has been rolled in accordance with the fourth embodiment of the first aspect this invention.

The rolled material S' which has been subjected to its prescribed edging in the above manner is then rolled to a desired thickness dimension by horizontal rolls a work roll, which is composed as illustrated in FIG. 22 of a convex roll 45 bulged out at its longitudinal central portion and a concave roll 46 defining a curved-in portion in its longitudinal central portion, in view of the overall rolling process, for example, from the viewpoint of rough rolling facilities of a hot strip mill. Here, the crown heights Cr, −Cr of the convex roll 45 and concave roll 46 may be determined in view of rolling conditions, for example, the level of edging reduction and the extent of rolling reduction in each horizontal pass. When a 4-stage rolling mill is used as a horizontal roll, it is possible particularly to use a flat roll in place of the convex roll 46 as its working roll and to impart a negative crown height −Cr to its backup roll. These rolls can deform each stock material S when the stock material is rolled, thereby forming the stock material into a desired shape.

As apparent from the above explanation, the edger rolling method according to the fourth embodiment of the first aspect of this invention allows achievement of a large edging reduction. In addition, it has also made it possible to reduce the number of edging passes when performing rough rolling. Owing to the large edging reduction, it has become feasible to form stock materials into fewer widthwise dimensions. This does not only improve the productivity of casting facilities by the reduction in variety to the dimensions of cast ingots in the continuous casting process but also permits the continuous combination of the continuous casting process and the rolling process. Accordingly, the process of the fourth embodiment of the first aspect of this invention can bring about many advantageous effects.

In the above-described fourth embodiment, each stock material is caused to bulge downwardly by special rolls prior to its edging. Vertical rolls may also be used in place of such special rolls to bulge stock materials.

Figure 24:
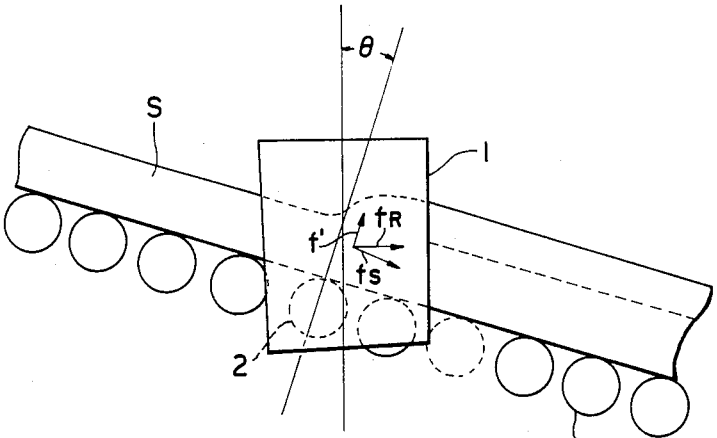
FIGS. 24 to 26 illustrate an edger rolling method of a plate-like material, which method pertains to the fifth embodiment of the first aspect this invention.
Figure 25:
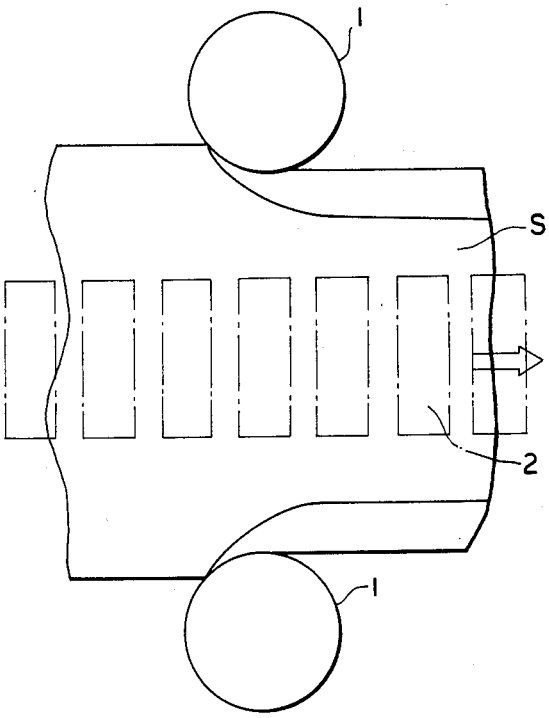

In FIGS. 24 and 25, the table roller 2 feeds the stock material S at a suitable angle $\theta°$ with respect to the advancing direction of the stock material S. The thusfed stock material S is then brought into bitten engagement with vertical rolls 1,1 which are tilted relative to the table roller 2. Then, the stock material S which has been brought into bitten engagement with the vertical rolls 1,1 is rolled widthwise owing to the rolling loads F applied thereto from the vertical rolls 1,1. Here, a force f' toward the upward plate thickness direction is exerted to each side edge portion of the stock material S owing to the combination of a kinetic vector $f_R$ produced in the direction of rotation of the vertical roll 1 and another kinetic vector $f_S$ developed in the advancing direction (i.e., rolling direction) of the stock material S, because the vertical rolls 1,1 are tilted relative to their corresponding side edges of the stock material S which is also kept tilted. Thus, an upward deformation is developed in each side edge portion of the stock material S. These deformations of the side edge portions of the stock material S shift the points of action of the rolling loads F to develop a bending moment. This bending moment then develops a downward deformation in the stock material S. Therefore, this downward bending deformation of the stock material S is brought into contact with the table roller 2 arranged between the vertical rolls 1,1, thereby causing the table roller 2 to produce a counter force and thus to support the stock material S. As a result, the bending moment developed in the stock material S by the rolling loads F upon its edging operation is balanced with the counter force. In other words, the direction of deformation caused due to buckling of the stock material S is controlled and is thus balanced with the counter force produced by the table roller. Therefore, the development of deformation is converted to means for suppressing the formation of buckling. The edging operation according to the method of the fifth embodiment of the first aspect of this invention is carried out in the above-described manner.

Figure 26:
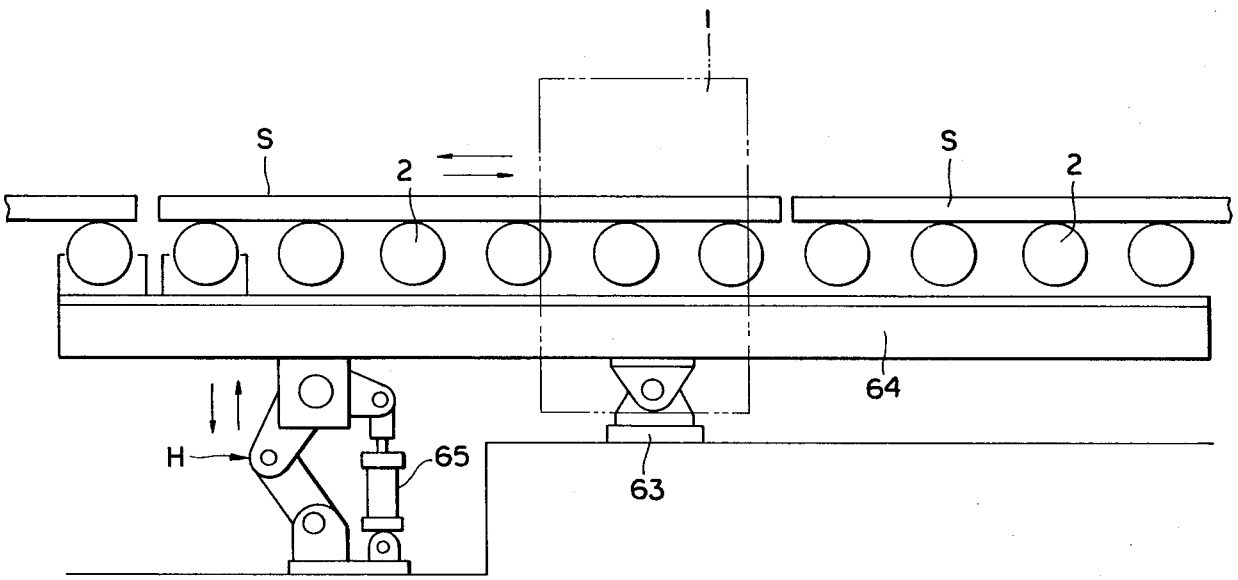

FIG. 26 shows the approximate structure of a rolling mill useful in the practice of the edger rolling method of plate-like material, which method pertains to the fifth embodiment of the first aspect of this invention. In FIG. 26, the stock material S has not still been tilted in the advancing direction of the stock material S relative to the paired rolls 1. Upon starting the rolling, an elevator H is raised as indicated by an arrow ↑ by actuating its cylinder 65. Then, the table roller 2 mounted on a table 64 is titled about a support table 3 as a fulcrum clockwise over a suitable angle $\theta°$ in FIG. 26, thereby bringing the stock material S in a tilted position into bitten engagement with the vertical rolls 1. Upon completion of the rolling operation, the cylinder 65 of the elevator H is again actuated to lower the elevator H as indicated by an arrow ↓ to its initial position. In the above explanation, the stock material S was caused to advance in the direction indicated by an arrow →. When the stock material S is caused to advance in the direction indicated by an arrow ←, the cylinder 65 of the elevator H is actuated in such as way that the elevator H descends as shown by the arrow ↓. Therefore, the table roller 2 is tilted counterclockwise about the support table 63 as the fulcrum. After completion of the rolling operation, the cylinder 65 is conversely expanded as indicated by the arrow so that the table roller 2 regains its initial position.

Figure 27:
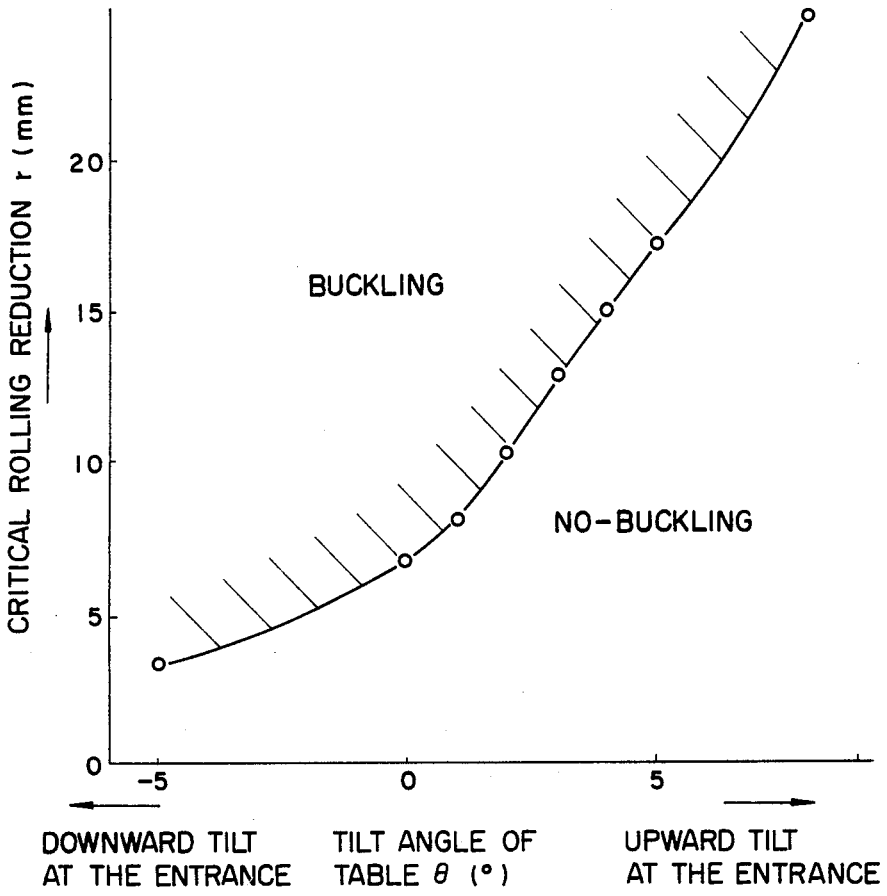
FIG. 27 diagrammatically illustrates the effect of the tilt angle of a table on the rolling reduction in the edger rolling method according to the fifth embodiment of the first aspect this invention.

FIG. 27 illustrates the results of an experiment which was conducted using plasticine. As stock materials S, there were used flat plasticine plates each of which had a thickness of 10 mm and width of 150 mm and had been cooled to 0°. The rolling of the stock materials was carried out by changing their tilt angles $\theta°$ within the range of 0°, 12 , 2°, 3°, 4°, 5° and 8° while at the same time, changing their rolling reductions to 5 mm, 10 mm, 15 mm and 25 mm. The influence of tilt angles of vertical rolls on widthwise rolling reduction was investigated in terms of the relationship between the tilt angles and their corresponding rolling reductions which induced buckling. As readily envisaged from the results shown in FIG. 27, it is understood that the maximum rolling reduction which does not cause buckling increases as the tilt angle becomes greater.

The edger rolling method according to the fifth embodiment of the first aspect of this invention is thus able to increase edging reductions for stock materials, thereby solving the limitations to the widthwise dimensions of stock materials. It has also improved the widthwise dimensional accuracy owing to the successful prevention of buckling. It has therefore brought about significant contributions to the industry, including an improved production yield.

Figure 28:
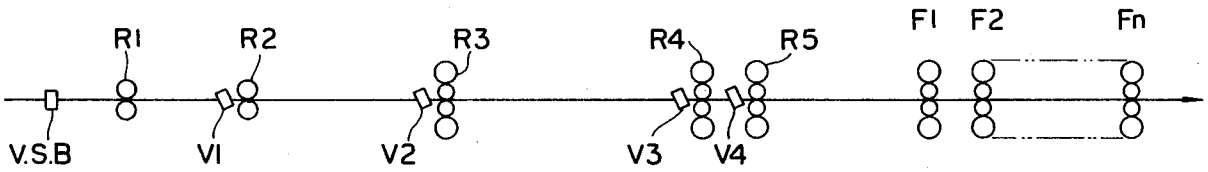
FIGS. 28 and 29 depict a continuous hot rolling mill according to the second aspect of this invention.
Figure 29:
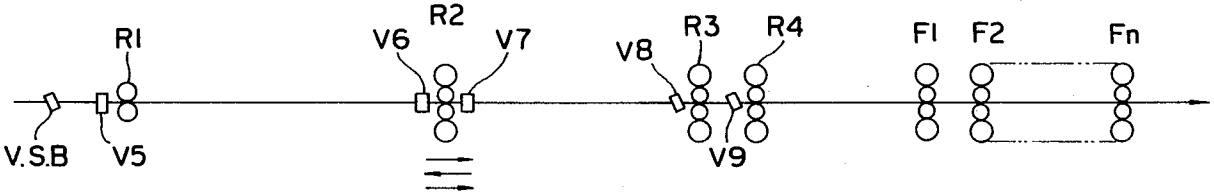

The above-described edger rolling methods may be practiced by the continuous hot rolling mill according to the second aspect of this invention. One example of the continuous hot rolling mill is shown in FIG. 28. Namely, FIG. 28 illustrates the arrangement of a hot strip rolling mill of the fully continuous type. There are arranged a vertical scale breaker VSB and a continuous rolling train of rough rolling mills $R_1$–$R_5$, followed by continuous finishing mills $F_1$–$F_n$. Out of the train of rough rolling mills $R_1$–$R_5$, the rough rolling mills $R_2$–$R_5$are respectively equipped with vertical rolling mills $V_1$–$V_4$ adapted to perform edging of each stock material. The vertical rolling mills $V_1$–$V_4$ are disposed in such a way that the central axes of their rolls are tilted at a suitable angle $\theta$ in the direction opposite to the advancing direction of the stock material in vertical planes parallel to the advancing direction of the stock material. On the othere hand, FIG. 29 illustrates the arrangement of a hot strip rolling mill of the three quarter type. There is arranged a train of rough rolling mills which is composed of a vertical scale breaker VSB, a rough rolling mill $R_1$ adapted to roll stock materials either reversibly or irreversibly, a reversible 4-stage rolling mill $R_2$, and 4-stage rolling mills $R_3$,$R_4$ adapted to roll stock materials in only one direction. Following the rough rolling mills $R_1$–$R_4$, continuous finishing mills $F_1$–$F_n$ are also arranged. In the train of the rough rolling mills $R_1$–$R_4$, the rough rolling mills $R_1$–$R_4$ are respectively provided with vertical rolling mills $V_5$–$V_9$ which are adapted to edge stock materials. Among the vertical scale breaker VSB and vertical rolling mills, the vertical rolling mills for latter-stage rough rolling mills, namely, the vertical rolling mills $V_8$,$V_9$corresonding respectively to the rough rolling mills $R_3$,$R_4$ are arranged with the central axes of their rolls tilted in the manner described above, i.e., at a suitable angle $\theta$ in the direction opposite to the advancing direction of each stock material within vertical planes parallel to the advancing direction of the stock material.

Figure 30:
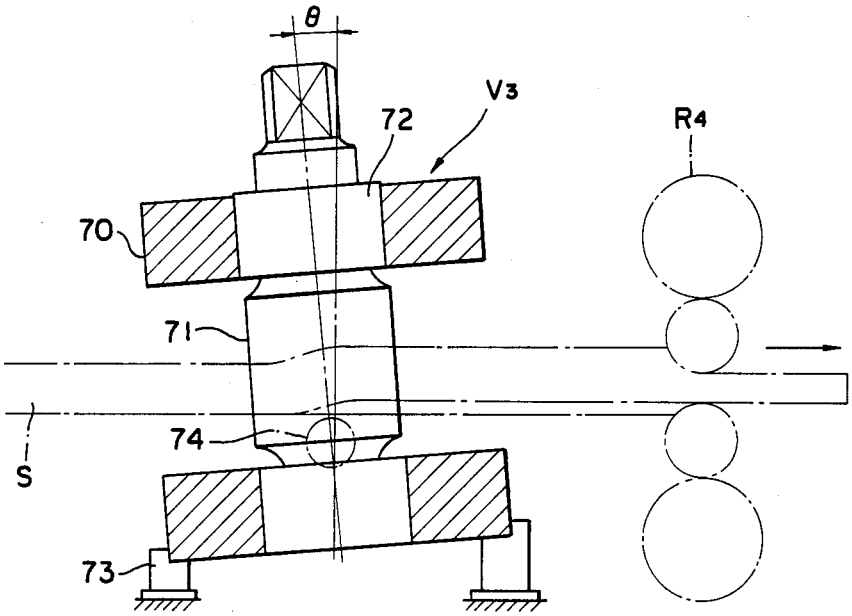
FIG. 30 is a schematic illustration showing the approximate structure of an upright rolling mill.
Figure 31:
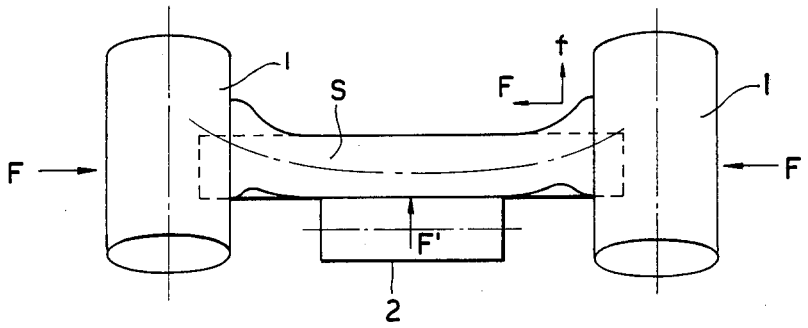
FIGS. 31 and 32 schematically show the principle of rolling by an edger.
Figure 32:
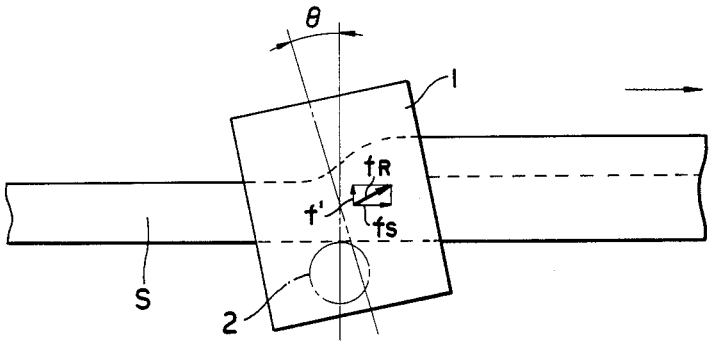

The outline of the vertical rolling mills is now described, taking the vertical rolling mill $V_3$ by way of example. As depicted in FIG. 30, a vertical roll 71 rotatably supported by way of journal boxes 72 in a housing 70 of the rolling mill is mounted movably back and forth in the widthwise direction of the stock material S. The housing 70 of the rolling mill is mounted on bases 73 in such a way that the central axis of the vertical roll 71 is tilted by such a suitable angle $\theta$ as to direct the central axis in the direction opposite to the advancing direction of the stock material S in a vertical plane parallel to the advancing direction of the stock material S. In addition, a table roller 74 is provided rotatably underneath the pass line between a pair of vertical rolls. 71. The principle of the edging mechanisms of the vertical rolling mills $V_1$–$V_4$,$V_8$,$V_9$ is schematically illustrated in FIGS. 30–32. Namely, the paired vertical rolls 1,1 having smooth surfaces are in advance tilted at the suitable angle $\theta°$ in the direction opposite to the advancing direction (indicated by an arrow in FIGS. 30 and 32) of the stock material S, namely toward the incoming side of the stock material. The stock material S is then brought into bitten engagement with the thus-tilted vertical rolls 1,1. The stock material S which has been brought into bitten engagement with vertical rolls 1,1 is subjected to the rolling loads F from the vertical rolls 1,1, thereby being rolled widthwise. Since each of the vertical rolls 1,1 is arranged aslant relative to its corresponding side edge of the stock material S, a kinetic vector is produced in the direction of rotation of the vertical roll 1. Then plate thicknesswise vector f' component and horizontal vector $\nu°$ component are produced as divided vectors of rotational direction vector. The f' acts upwardly on its corresonding side edge portion of the stock material S. Accordingly, upward deformations occur in the side edge portions of the stock material S. These upward deformations then shift the points of action of the rolling loads F,F to the stock material S, leading to development of a bending moment. This bending moment then develops a downwardly-bent deformation. This downwardly-bent deformation of the stock material S is brought into contact with the table roller 2 arranged between the vertical rolls 1,1 and is hence supported by a counter force developed by the table roller 1. Therefore, the bending moment produced in the stock material S by the rolling loads F,F upon its edging is balanced with the counter force. In othere words, deformation caused due to buckling of the stock material S is controlled and is thus balanced with the counter force produced by the table roller. Therefore, the development of the deformation is converted to means for suppressing the foramtion of buckling. The continuous hot rolling mill according to the second aspect of this invention can conduct edging operations in the above-described manner.

As apparent from the above description, the central axes of the rolls of the vertical rolling mills of the train of continuous hot rolling mills according to the second aspect of this invention are tilted in the direction opposite the advancing direction of each stock material so as to prevent the stock material from developing the buckling phenomenon. It can therefore achieve large edging reductions and can hence reduce the number of edging passes for each stock material. Thus, the temperature drop of the stock material can be avoided and the widthwise dimensional accuracy can be improved, thereby to improve the productivity of facilities. Furthermore, the reduction to the number of passes allows not only to reduce the number of stands for vertical rolling mills but also to produce cast blocks having fewer varieties of dimensions in the continuous casting process which precedes the rolling process. Thus, the continuous hot rolling mill according to the second aspect of this invention can bring about such extremely-great effects that the productivity of such continuous casting facilities can be improved and resulting continuous cast slabs can be fed directly to the continuous hot rolling mill.

In the third aspect, this invention pertains to an edger roll useful in the practice of the edger rolling methods according to some embodiments of the first aspect of this invention.

An edger roll according to one embodiment of the third aspect of this invention will next be described with reference to FIGS. 33 and 34. It should however been borne in mind that the illustrated edger roll does not limit the third aspect of this invention and may be changed or modified as desired with the scope of technical concept of the third aspect of this invention.

Figure 33:
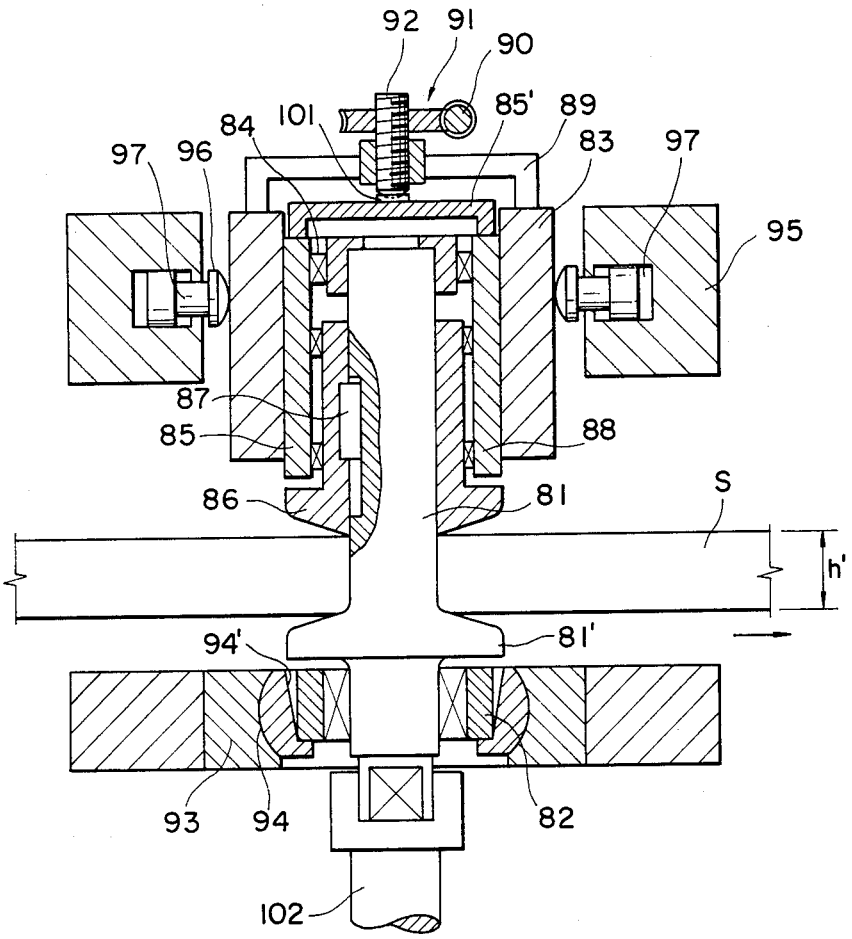
FIG. 33 is a fragmentary cross-sectional front elevational view of an edger roll according to the third aspect of this invention.
Figure 34:
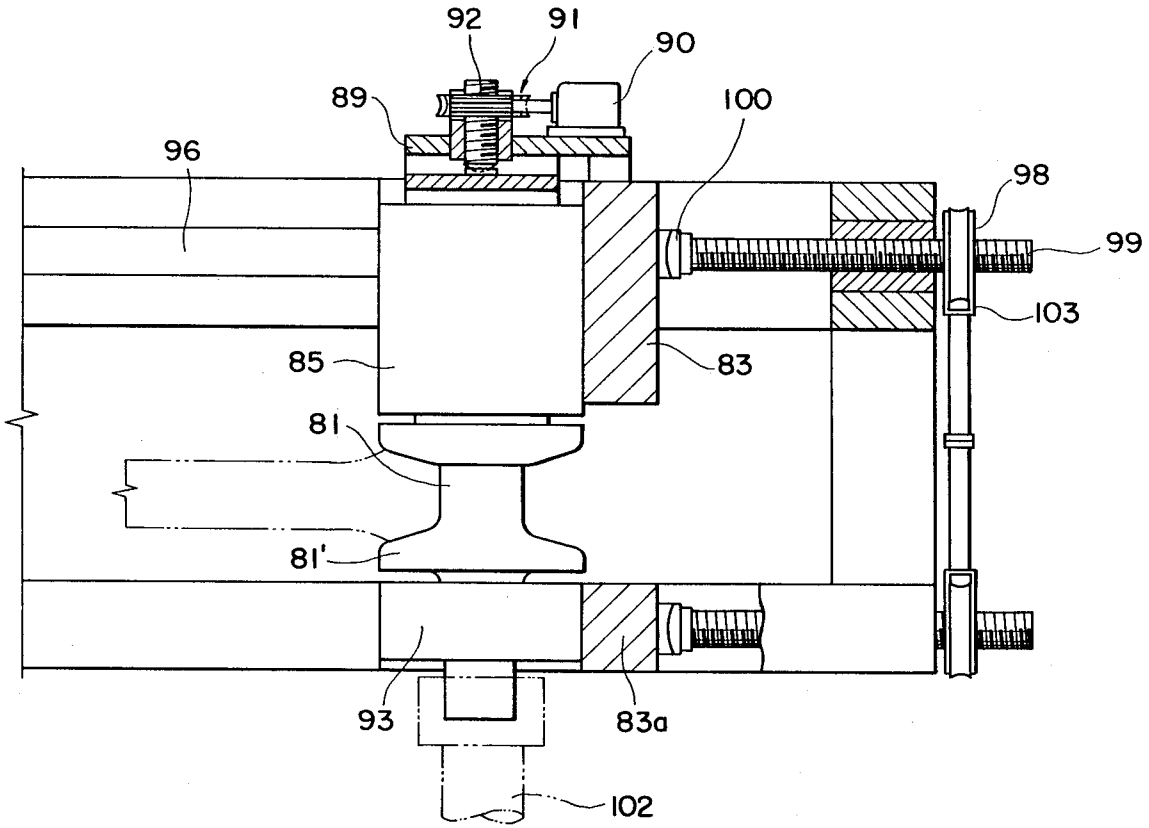
FIG. 34 is a fragmentary cross-sectional side elevational view of the edger roll.

FIGS. 33 and 34 illustrate only one of the rolls arranged in a pair with a pass line interposed therebetween in order to facilitate the description of the edger roll. A roll shaft 81 equipped with a flange portion 81' formed thereon is rotatably supported at its lower end portion by a journal box 82. On the other hand, its upper end portion is attached to a movable frame 83 by way of a bearing 84 slidable relative to a journal box 85 fit slidably in the axial direction in the movable frame 83. A flanged roll 86 is fit over the roll shaft 81 by way of a key 87 in such a manner that the flanged roll 86 confronts the flange portion 81' of the roll shaft 81 and is movable up an down along the central axis of the roll shaft 81. This flanged roll 86 is also rotatably supported in the journal 85 via a bearing 88. The journal box 85 is slidably fit within the movable frame 83 and is normally kept, owing to the provision of a roll balancer although it is not shown in the drawings, in contact via a holder plate 85' with a threaded shaft 92 driven by a worm screw mechanism 91 which is in turn driven by a motor 90 mounted on a base 89 provided with the movable frame 83. The journal box 85 is thus caused to move up and down in accordance with each movement of the threaded shaft 92. In other words, the flanged roll 86 supported by the journal 85 is moved up and down along the central axis of the roll shaft 81. The journal box 82 which supports the roll shaft 81 is fit in a cavity 94' of a boss 94 fit in a lower moving frame 93, which moves within the housing 95, and having an arcuate circumferential outer wall. The journal box 82 is thus tiltable within a vertical plane parallel to the advancing direction of each stock material. The upper movable frame 83 is supported by supporting rods 96 buried in the inner wall of the housing 95. These supporting rods can be advanced or retracted by cylinders 97 provided behind the supporting rods and in the housing 95. Thus, the movable frame 83, in other words, the roll shaft 81 can be tilted. The movable frame 83 and lower movable frame 93 are connected to a conventionally-known rolling mechanism provided with the housing 95. Namely, the movable frame 83 and lower movable frame 93 are connected via rolling shoes 100 to worms 103 driven by a motor (not shown), worm wheels 98 kept in meshing engagement with the worms 103, and threaded shafts 99 kept in engagement with the worm wheels 98. The movable frame 83 and lower movable frame 93 thus roll the stock material S in its widthwise direction.

By the way, designated by numberal 101 in FIG. 33 is a load sensor interposed between the threaded shaft 92 and the holding plate 85' of the journal box 85 and adapted to detect each rolling counter force applied to the flanged roll 86. Numeral 102 indicates a universal spindle for transmitting rotary forces to the roll.

In the edger roll having the above-described structure, each rolling rotary force is transmitted to the roll shaft 81 by way of the universal spindle 102. It is then transmitted via the key 87 to the flanged roll 86, thereby rotating the flanged wheel, journalled by the journal box 85, together with the roll shaft 81 as an integral unit. When the caliber dimension is changed in accordance with the thickness h' of the stock material S, the motor 90 on the base 89 is turned on. Then, the threaded shaft 92 is rotated by the worm screw mechanism 91. This rotary force is transmitted to the holding plate 85' of the journal box 85, thereby causing the journal box 85 to move up or down along the inner wall of the movable frame 83. Therefore, the caliber dimension is adjusted in accordance with the thickness dimension h' of the stock material S. Then, the movable frame 83 and lower movable frame 93 are both displaced widthwise by the rolling mechanism mounted on the housing 95 so that the stock material S is rolled widthwise.

When a rolling counter force detected by the load sensor 101 interposed between the threaded shaft 92 and holding plate 85' is compared with a value detected by the load sensor 101 provided at the opposite side relative to the advancing direction of the stock material S and their difference exceeds a preset load difference, either one of the cylinders 97 provided in the housing 95 is selectively actuated so as to cause its corresponding supporting rod 96 to project inwardly from the housing 95, thereby pressing the movable frame 83 and tilting the roll shaft 81. Let's now suppose by way of example that the stock material S is advancing in the direction indicated by an arrow in FIG. 33. When the left-hand cylinder 97 is actuated to cause the supporting rod 96 to project out inwardly from the housing 95, the journal box 85, which supports the roll shaft 81, and the movable frame 83 are both pressed. As a result, the boss 94 of the lower movable frame 93, which receives the journal box 82 supporting the roll shaft 81, is rotated owing to its arcuate circumferential profile. Therefore, the central axis of the roll shaft 81 is tilted in a vertical plane parallel to the advancing direction of the stock material S. This tilting of the roll shaft 81 produces a force pressing the stock material downwardly as a thicknesswise component of the kinetic vector produced in the direction of rotation of the roll shaft 81. The thus-produced force acts in such a direction that it presses the stock material S against the flange portion 81' formed on the roll shaft 81. Therefore, the flanged roll 86 is protected from exertion of excessive rolling counter forces. As a result, the worm screw mechanism 91 which is a mechanism for adjusting the caliber dimension of the flanged roll 86 is kept free from excessive transmission of the aforementioned rolling counter forces thereto.

As clearly envisaged from the above description, the edger roll according to the third aspect of this invention can protect its caliber-adjusting mechanism from excessive rolling counter forces. This permits use of a relatively simple structure for the caliber-adjusting mechanism. Therefore, the edger roll can bring about significant advantageous effects.

Having now fully described the invention, it will be apparent to one of ordinary skill in the art that many changes and modifications can be made thereto without departing from the spirit or scope of the invention as set forth herein. Therefore, the invention can be applied not only to rough hot rolling the plate and sheet materials but also to finishing hot rolling thereof or even cold rolling thereof.

What is claimed is:

1. A process for width reduction of plate-like stock material, which method comprises:

positioning said first and second single driven vertical rolls in spaced relationship on opposite end portions of a table roller;

feeding said plate-like stock material between said first and second driven single vertical rolls such that opposite side edger of said stock material respectively are engaged by said first and second driven single vertical rolls;

tilting the central axis of said first and second driven single vertical rolls so as to be tilted in a direction opposite the advancing direction of the stock material in respective vertical planes which are parallel to the advancing direction of the stock material;

contacting said plate-like material with said table roller such that said table roller supports said plate-like stock material via a counter force;

maintaining the first and second single vertical rolls tilted toward the direction opposite the advancing direction of the plate-like stock material and simultaneously bringing the plate-like stock material into engagement with the first and second single vertical rolls so as to be edged by the first and second single vertical rolls and rotating said rolls so as to apply an upward force on edges of said plate-like stock material and develop a downward bending deformation in the plate-like stock material has a downward convex shape; and receiving the downward bending deformation of the plate-like stock material as a reaction force by said table roller, to thereby perform edging of the stock material while balancing bending moments, which are developed in the plate-like stock material during edging of the plate-like stock material, by means of said table roller.

2. The method as claimed in claim 1, which further comprises advancing the stock material machined to make the width between the lower side edges thereof shorter than the width between the upper side edges thereof and thereafter rolling the stock material.

3. The method as claimed in claim 1, which further comprises prebending the stock material in such a way that the widthwise cross-sectional profile thereof is bulged smoothly and downwardly, and carrying out rolling of the stock material while receiving deformations, which are to be developed in the stock material during edging of the stock material, as reaction forces by a table roller arranged underneath the stock material.

* * * * *